US010573430B2

(12) United States Patent
Wessels, Jr. et al.

(10) Patent No.: US 10,573,430 B2
(45) **Date of Patent: *Feb. 25, 2020**

(54) SEPARATOR TAPE FOR TWISTED PAIR IN LAN CABLE

(71) Applicant: CommScope, Inc. of North Carolina, Hickory, NC (US)

(72) Inventors: Robert A. Wessels, Jr., Hickory, NC (US); David A. Wiebelhaus, Hickory, NC (US); Trent M. Hayes, Hickory, NC (US); Wayne C. Hopkinson, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/979,302

(22) Filed: May 14, 2018

(65) Prior Publication Data

US 2018/0261359 A1 Sep. 13, 2018

Related U.S. Application Data

(63) Continuation of application No. 15/224,620, filed on Jul. 31, 2016, now Pat. No. 9,978,480, which is a continuation-in-part of application No. 14/249,519, filed on Apr. 10, 2014, now Pat. No. 9,418,775, which is a continuation-in-part of application No. 13/182,778, filed on Jul. 14, 2011, now abandoned, which is a continuation of application No.

(Continued)

(51) Int. Cl.

| | |
|---|---|
| ***H01B 11/04*** | (2006.01) |
| ***H01B 11/00*** | (2006.01) |
| ***H01B 11/06*** | (2006.01) |

(52) U.S. Cl.
CPC ..... *H01B 11/002* (2013.01); *H01B 11/06* (2013.01)

(58) Field of Classification Search
CPC ..... H01B 11/04
USPC ..... 174/113 R, 113 C, 27
See application file for complete search history.

(56) References Cited

U.S. PATENT DOCUMENTS

| | | | |
|---|---|---|---|
| 1,305,247 | A | 6/1919 | Beaver et al. |
| 1,883,269 | A | 10/1932 | Yonkers |
| 1,976,847 | A | 10/1934 | Gordon et al. |

(Continued)

FOREIGN PATENT DOCUMENTS

| | | |
|---|---|---|
| EP | 1139350 | 10/2001 |
| GB | 669404 | 4/1952 |

(Continued)

*Primary Examiner* — Chau N Nguyen
(74) *Attorney, Agent, or Firm* — Muncy, Geissler, Olds & Lowe, P.C.

(57) ABSTRACT

A cable includes a jacket surrounding first and second insulated conductors and a first dielectric tape, wherein the first insulated conductor is twisted with the second insulated conductor with the first dielectric tape residing therebetween to form a first twisted pair. The cable's jacket may also surround additional twisted pairs, which are similarly formed. In alternative or supplemental embodiments of the invention, the first dielectric tape has a hollow core possessing a gas or material with a lower dielectric constant and/or at least a first side of said first dielectric tape facing to said first insulated conductor includes a plurality of ridges and valleys.

20 Claims, 23 Drawing Sheets

Related U.S. Application Data

12/407,407, filed on Mar. 19, 2009, now Pat. No. 7,999,184.

(60) Provisional application No. 61/037,904, filed on Mar. 19, 2008.

(56) References Cited

U.S. PATENT DOCUMENTS

| | | | | |
|---|---|---|---|---|
| 2,804,494 | A | 8/1957 | Fenton | |
| 3,244,799 | A | 4/1966 | Roberts | |
| 3,364,305 | A | 1/1968 | Hanlon et al. | |
| 3,622,683 | A | 11/1971 | Roberts et al. | |
| 3,678,177 | A | 7/1972 | Lawrenson | |
| 3,848,073 | A | 11/1974 | Simons et al. | |
| 4,034,148 | A | 7/1977 | Lang | |
| 4,218,580 | A | 8/1980 | Pound et al. | |
| 4,920,234 | A | 4/1990 | Lemke | |
| 5,132,488 | A | 7/1992 | Tessier et al. | |
| 5,149,915 | A | 9/1992 | Brunker et al. | |
| 5,286,923 | A | 2/1994 | Prudhon et al. | |
| 5,519,173 | A | 5/1996 | Newmoyer et al. | |
| 5,574,250 | A | 11/1996 | Hardie et al. | |
| 5,658,406 | A | 8/1997 | Walling et al. | |
| 5,789,711 | A | 8/1998 | Gaeris et al. | |
| 5,821,467 | A | 10/1998 | O'Brien et al. | |
| 5,952,615 | A | 9/1999 | Prudhon | |
| 5,969,295 | A | 10/1999 | Boucino et al. | |
| 6,091,025 | A | 7/2000 | Cotter et al. | |
| 6,147,309 | A | 11/2000 | Mottine et al. | |
| 6,150,612 | A | 11/2000 | Grandy et al. | |
| 6,162,992 | A | 12/2000 | Clark et al. | |
| 6,211,467 | B1 * | 4/2001 | Berelsman ..... | H01B 7/1895 174/113 C |
| 6,248,954 | B1 | 6/2001 | Clark et al. | |
| 6,506,976 | B1 | 1/2003 | Neveux, Jr. | |
| 6,770,819 | B2 | 8/2004 | Patel | |
| 6,875,928 | B1 | 4/2005 | Hayes et al. | |
| 7,015,398 | B2 | 3/2006 | Vexler et al. | |
| 7,214,883 | B2 | 5/2007 | Leyendecker | |
| 7,317,163 | B2 | 1/2008 | Lique et al. | |
| 9,418,775 | B2 * | 8/2016 | Wessels, Jr. ..... | H01B 11/06 |
| 9,659,686 | B1 | 5/2017 | McNutt | |
| 9,978,480 | B2 * | 5/2018 | Wessels, Jr. ..... | H01B 11/06 |
| 2003/0121695 | A1 | 7/2003 | Wiebelhaus et al. | |
| 2006/0237220 | A1 | 10/2006 | Leyendecker | |
| 2007/0295526 | A1 | 12/2007 | Stutzman et al. | |
| 2008/0066947 | A1 | 3/2008 | Glew | |
| 2008/0073106 | A1 | 3/2008 | Brake et al. | |
| 2009/0236120 | A1 | 9/2009 | Wiebelhaus et al. | |

FOREIGN PATENT DOCUMENTS

| | | |
|---|---|---|
| GB | 1322752 | 7/1973 |
| JP | 3722064 | 11/2005 |
| WO | 03/077265 | 9/2003 |
| WO | 2006/132716 | 12/2006 |

* cited by examiner

SEPARATOR TAPE FOR TWISTED PAIR IN LAN CABLE

This application is a continuation of U.S. application Ser. No. 15/224,620 filed Jul. 31, 2016, now U.S. Pat. No. 9,978,480, which is a continuation-in-part of U.S. application Ser. No. 14/249,519 filed Apr. 10, 2014, now U.S. Pat. No. 9,418,775, which is a continuation-in-part of U.S. application Ser. No. 13/182,778 filed Jul. 14, 2011, now abandoned, which is a continuation of U.S. application Ser. No. 12/407,407 filed Mar. 19, 2009, now U.S. Pat. No. 7,999,184, which claims the benefit of U.S. Provisional Application No. 61/037,904, filed Mar. 19, 2008, the contents of each application is herein incorporated by reference.

BACKGROUND OF THE INVENTION

1. Field of the Invention

The present invention relates to a twisted pair cable for communication of high speed signals, such as a local area network (LAN) cable. More particularly, the present invention relates to a twisted pair cable having a dielectric tape between first and second insulated conductors of a twisted pair.

2. Description of the Related Art

As shown in FIGS. 1 and 2, the Assignee's prior U.S. Pat. No. 6,506,976 shows a LAN cable 1 having a jacket J surrounding first through fourth twisted pairs A, B, C, D which are spaced from each other by a separator 3. Each of the twisted pairs A, B, C, D includes a first insulated conductor 5, a dielectric tape 7, and a second insulated conductor 9, wherein the first insulated conductor 5 is twisted with the second insulated conductor 9 with the dielectric tape 7 residing between the first insulated conductor 5 and the second insulated conductor 9.

As best seen in the close-up cross sectional view of the twisted pair A in FIG. 2, the width of the dielectric tape 7, which extends between opposing edges 11 and 13, is set to extend beyond the first and second insulated conductors 5 and 9. By this arrangement, the opposing edges 11 and 13 of the dielectric tape 7 circumscribe an area 15, around the twisted pairs A, B, C, D. The area 15 creates a spacing between the twisted pairs A, B, C, D and the separator 3 and between the twisted pairs A, B, C, D and the jacket J. This spacing around the twisted pairs A, B, C, D can improve the electrical performance of the cable 1, such as by reducing crosstalk.

In typical cables of the background art, the first insulated conductor 5 would be formed by a first conductor 17 of about twenty-three gauge size, surrounded by a layer of a first dielectric insulating material 19 having a radial thickness greater than seven mils, such as about tens mils or about eleven mils for a typical CAT 6 cable. Likewise, the second insulated conductor 9 would be formed by a second conductor 21 of about twenty-three gauge size, surrounded by a layer of a second dielectric insulating material 23 having a same or similar radial thickness.

SUMMARY OF THE INVENTION

Although the cable of the background art performs well, Applicants have appreciated some drawbacks. Applicants have invented a twisted pair cable with new structural features, the object of which is to enhance one or more performance characteristics of a LAN cable, such as reducing insertion loss, matching impedance, reducing propagation delay and/or balancing delay skew between twisted pairs, and/or to enhance one or more mechanical characteristics of a LAN cable, such as improving flexibility, reducing weight, reducing cable diameter and reducing smoke emitted in the event of a fire.

These and other objects are accomplished by a cable that includes a first insulated conductor, a first dielectric tape, and a second insulated conductor, wherein the first insulated conductor is twisted with the second insulated conductor with the first dielectric tape residing therebetween to form a first twisted pair. A jacket is formed around the first twisted pair. The cable may also include a third insulated conductor, a second dielectric tape, and a fourth insulated conductor, wherein the third insulated conductor is twisted with the fourth insulated conductor with the second dielectric tape residing therebetween to form a second twisted pair. If the second twisted pair is provided, the jacket is formed around both the first and second twisted pairs.

In a first alternative or supplemental objective of the invention, the first insulated conductor includes a first conductor surrounded by a layer of first dielectric insulating material having a radial thickness of about 7 mils or less.

In a second alternative or supplemental objective of the invention, the first dielectric tape is formed as a single unitary structure having a first width which extends approximately perpendicular to an extension length of the first twisted pair from a first edge of the first dielectric tape to a second edge of the first dielectric tape, wherein the first width is equal to or less than a diameter of the first insulated conductor plus a diameter of the second insulated conductor plus a thickness of the first dielectric tape.

In a third alternative or supplemental objective of the invention, the first dielectric tape has a cross sectional shape in a direction perpendicular to the extension length of the first twisted pair, which presents a first recessed portion for seating the first insulated conductor and a second recessed portion for seating the second insulated conductor.

In a fourth alternative or supplemental objective of the invention, a first twist length of the first twisted pair is between approximately 0.22 inches and approximately 0.38 inches, and a second twist length of the second twisted pair is different from the first twist length and is between approximately 0.22 inches and approximately 0.38 inches.

In a fifth alternative or supplemental objective of the invention, the first dielectric tape is different in shape, size or material content as compared to the second dielectric tape.

In a sixth alternative or supplemental objective of the invention, the first, second, third and fourth insulated conductors are identical in appearance, and the first dielectric tape is different in appearance from the second dielectric tape.

In a seventh alternative or supplemental objective of the invention, the first dielectric tape has a hollow core possessing a gas or material with a lower dielectric constant than a material used to form the first dielectric tape.

In an eighth alternative or supplemental objective of the invention, the first dielectric tape has at least a first side facing to said first insulated conductor, which includes a plurality of ridges and valleys.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limits of the present invention, and wherein.

DETAILED DESCRIPTION OF EMBODIMENTS OF THE INVENTION

Figure 1:
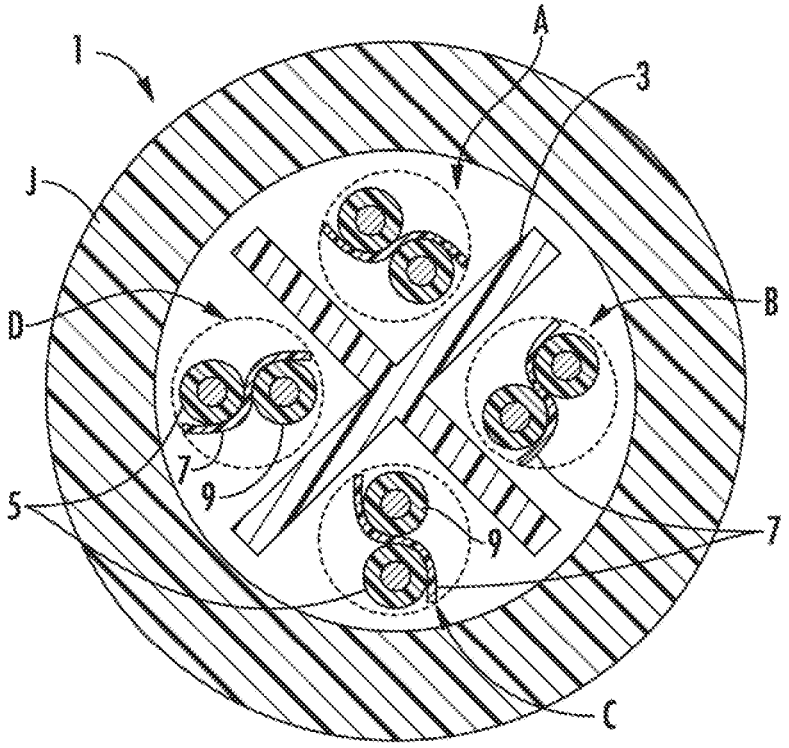
FIG. 1 (PRIOR ART)
FIG. 1 is a cross sectional view of a twisted pair cable, in accordance with the prior art.
Figure 2:
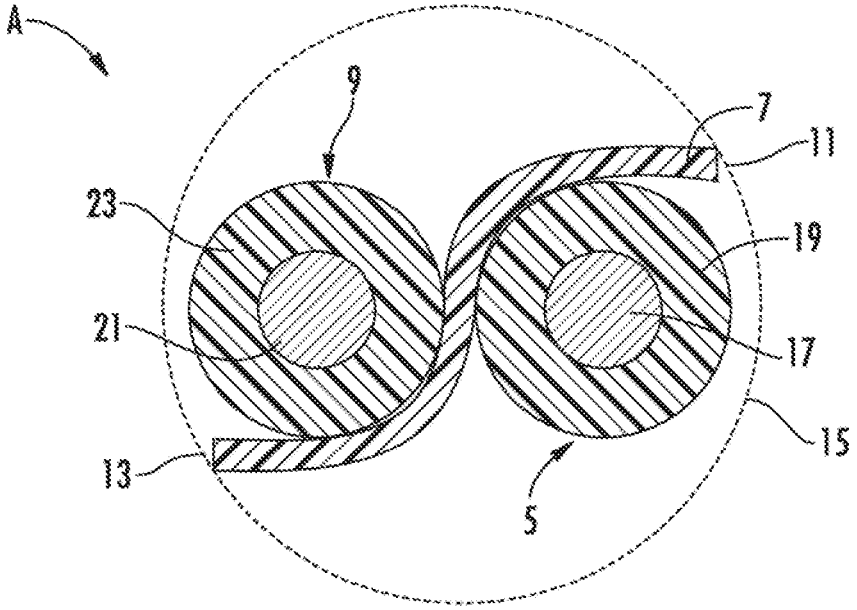
FIG. 2 (PRIOR ART)
FIG. 2 is a close-up cross sectional view of a twisted pair in the cable of FIG. 1.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Figure 3:
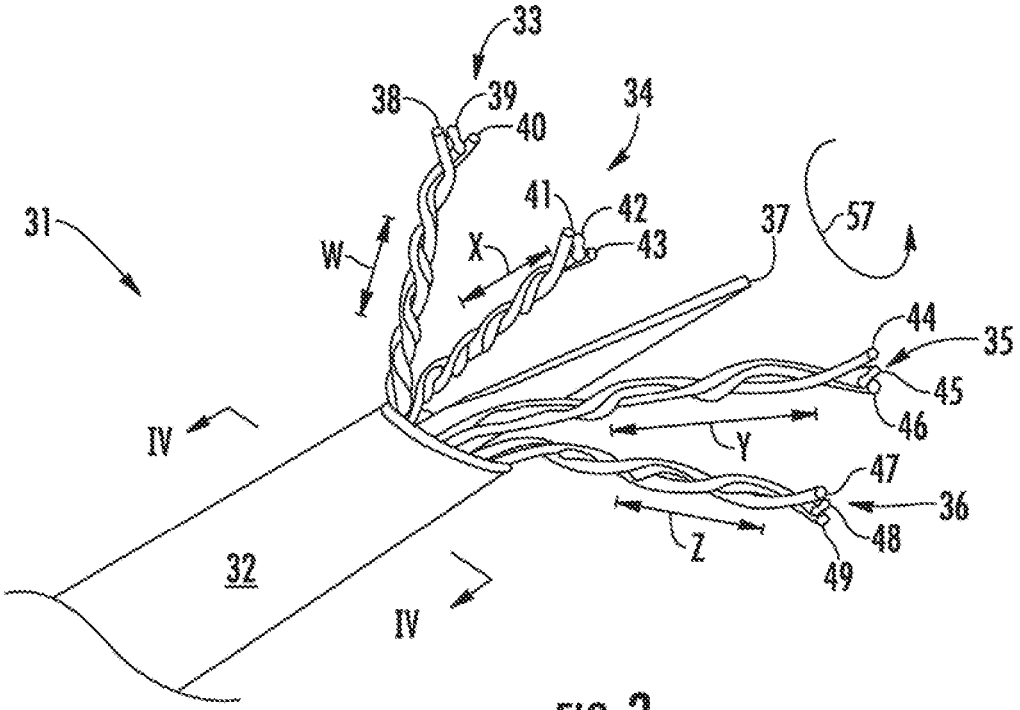
FIG. 3 is a perspective view of a twisted pair cable, in accordance with a first embodiment of the present invention.
Figure 4:
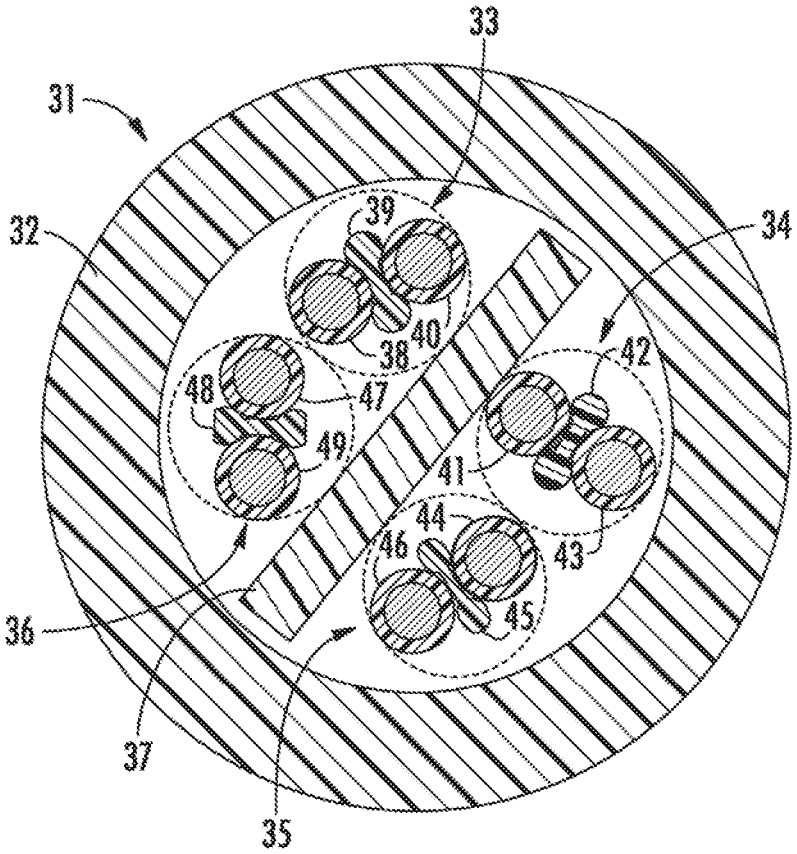
FIG. 4 is a cross sectional view of the twisted pair cable of FIG. 3 taken along line IV-IV.

FIG. 3 is a perspective view of a twisted pair cable 31, in accordance with a first embodiment of the present invention. FIG. 4 is a cross sectional view of the cable 31 taken along line IV-IV in FIG. 3. The cable 31 includes a jacket 32 formed around and surrounding first, second, third and fourth twisted pairs 33, 34, 35 and 36, respectively. The jacket 32 may be formed of polyvinylchloride (PVC), low smoke zero halogen PVC, polyethylene (PE), fluorinated ethylene propylene (FEP), polyvinylidene fluoride (PVDF), ethylene chlorotrifluoroethylene (ECTFE), or other foamed or solid materials common to the cabling art.

A separator 37 within the jacket 32 resides between and separates the first and fourth twisted pairs 33 and 36 from the second and third twisted pairs 34 and 35. In FIGS. 3 and 4, the separator 37 is formed by a thin strip of dielectric material, having a thickness of about twenty mils or less, more preferably eighteen mils or less, such as about fifteen mils. However, other sizes and shapes of separators 37 may be employed in combination with the present invention, such as plus-shaped or star-shaped separators, sometimes referred to as a flute, isolator, or cross-web. The separator 37 may be formed of any solid or foamed material common to the cabling art, such as a polyolefin or fluoropolymer, like fluorinated ethylene propylene (FEP) or polyvinylchloride (PVC).

As best seen in the cross sectional view of FIG. 4, the first twisted pair 33 includes a first insulated conductor 38, a first dielectric tape 39, and a second insulated conductor 40. The first insulated conductor 38 is twisted with the second insulated conductor 40, in a helical fashion, with the first dielectric tape 39 residing between the first insulated conductor 38 and the second insulated conductor 40.

The second twisted pair 34 includes a third insulated conductor 41, a second dielectric tape 42, and a fourth insulated conductor 43. The third insulated conductor 41 is twisted with the fourth insulated conductor 43, in a helical fashion, with the second dielectric tape 42 residing between the third insulated conductor 41 and the fourth insulated conductor 43.

The third twisted pair 35 includes a fifth insulated conductor 44, a third dielectric tape 45, and a sixth insulated conductor 46. The fifth insulated conductor 44 is twisted with the sixth insulated conductor 46, in a helical fashion, with the third dielectric tape 45 residing between the fifth insulated conductor 44 and the sixth insulated conductor 46.

The fourth twisted pair 36 includes a seventh insulated conductor 47, a fourth dielectric tape 48, and an eighth insulated conductor 49. The seventh insulated conductor 47 is twisted with the eighth insulated conductor 49, in a helical fashion, with the fourth dielectric tape 48 residing between the seventh insulated conductor 47 and the eighth insulated conductor 49.

Figure 5:
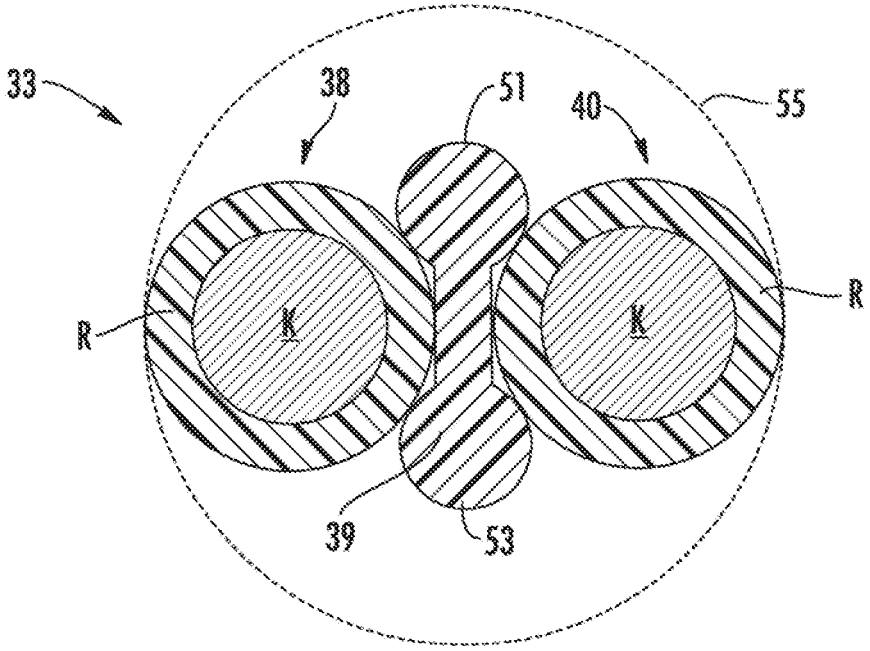
FIG. 5 is a close-up cross sectional view of a twisted pair from FIG. 4.

FIG. 5 is a close-up view of the first twisted pair 33, which is similarly constructed although not identically constructed (as will be detailed later in the specification) to the second, third and fourth twisted pairs 34, 35 and 36. Each of the first through eighth insulated conductors 38, 40, 41, 43, 44, 46, 47, 49 is formed by a conductor K surrounded by a layer of dielectric insulating material R, such as a polymer or foamed polymer, common to the cabling art like fluorinated ethylene propylene (FEP), polyethylene (PE) or polypropylene (PP). Further, the insulating material R may be formed by an enamel coating, or another nonconductive coating from a diverse art like motor armature windings. The conductor K may be solid or stranded, and may be formed of a conductive metal or alloy, such as copper. In one embodiment, the conductor K is a solid, copper wire of about twenty three gauge size.

In one embodiment, the insulating material R may have a radial thickness of about seven mils or less, more preferably about five mils or less. This radial thickness of the insulating layer R is at least 20% less than the standard insulation layer thickness of a conductor in a typical equivalent twisted pair wire, more preferably at least 25% to 30% less. Typically, such a thin insulation layer R would not be possible due to the incorrect impedance obtained when the conductors K of the first and second insulated conductors 38 and 40 become so closely spaced during the twisting operation due to the thinner insulating layers R. Typically, such thin insulation layers were not practiced in the background art, because there was no appreciation of a solution to the mechanical and performance problems. By the present invention, the interposed first dielectric tape 39 eases the mechanical stresses during twisting so that the thinner insulating layer R is undamaged and also spaces the conductors K apart so that a proper impedance may be obtained, e.g., one hundred ohms.

As best seen in FIG. 5, the first dielectric tape 39 has a first width which extends approximately perpendicular to an extension length of the first dielectric tape 39 from a first edge 51 of the first dielectric tape 39 to an opposing second edge 53 of the first dielectric tape 39. The first width is less than a diameter of the first insulated conductor 38 plus a diameter of the second insulated conductor 40 plus a thickness of the first dielectric tape 39, wherein the thickness is measured by the spacing created between the first and second insulated conductors 38 and 40. A typical spacing might be between four to twelve mils, such as about eight mils or about ten mils. By this arrangement, the twists of the first twisted pair 33 occupy a space within the dashed line 55, which is circumscribed by the helical twisting of the first and second insulated conductors 38 and 40. In this arrangement, the first through eighth insulated conductors 38, 40, 41, 43, 44, 46, 47 and 49 may contact each other if adjacent and also may contact the inner wall of the jacket 32.

Figure 5A:
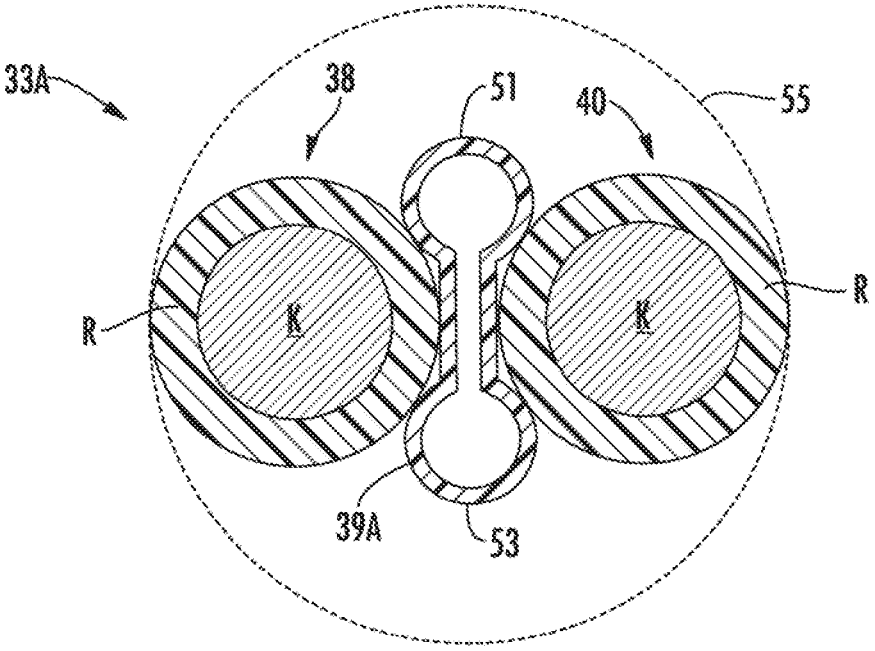
FIG. 5A is a close up cross sectional view of a twisted pair similar to FIG. 5, but illustrating that the dielectric tape may include a hollow air pocket.

In FIG. 5, the dielectric tape 39 is formed as a single unitary structure (e.g., the dielectric tape does not include multiple pieces attached together or layered). FIG. 5A illustrates that the solid dielectric tape 39 of FIG. 5 may be replaced with a dielectric tape 39A having a hollow core filled with a gas, like air (with a dielectric constant of 1.0) or a foamed insulation material (with a dielectric constant approaching 1.0). By filling the hollow core with a gas or material with a lower dielectric constant than a material used to form said first dielectric tape 39 or 39A, the overall dielectric constant of the first dielectric tape 39A may be reduced. The hollow core may extend the entire length of the dielectric tape 39A, resulting in a "straw-like" structure. Alternatively, support structures may be formed at intervals along the length of the dielectric tape 39A to form closed-cell air pockets, each having a short length, such as ½ inch, one inch, two inches, etc. Alternatively, one or more support structures may be formed within the hollow core, which extend along the length of the dielectric tape 39A and connect between the lateral walls of the hollow core to resist crushing of the hollow core during the twisting of the first twisted pair 33A. Although the other embodiments of the dielectric tapes of the present invention are illustrated with solid cores, hollow cores, as described in connection with FIG. 5A, may be employed in any or all of the other dielectric tapes. For example, see the hollow core in the configuration of FIG. 29, as compared to the configuration illustrated in FIG. 11. The first twisted pair 33A depicted in FIG. 5A may be substituted into the place of the first twisted pair 33 depicted in FIG. 4.

The first through fourth twisted pairs 33, 34, 35 and 36 may be stranded together in the direction 57 (see the arrow in FIG. 3) to form a stranded core. In one embodiment, the core strand direction 57 is opposite to the pair twist directions of the first through fourth twisted pairs 33, 34, 35 and 36. However, this is not a necessary feature, as in a preferred embodiment, the strand direction 57 is the same as the pair twist directions.

In preferred embodiments, the strand length of the core strand is about five inches or less, more preferably about three inches or less. In a more preferred embodiment, the core strand length is purposefully varied, or modulates, from an average strand length along a length of the cable 31. Core strand modulation can assist in the reduction of alien crosstalk. For example, the core strand length could modulate between two inches and four inches along the length of the cable 31, with an average value of three inches.

The first twist length w (See FIG. 3) of the first twisted pair 33 is preferably set to a short length, such as between approximately 0.22 inches and approximately 0.38 inches. The second twist length x of the second twisted pair 34 is different from the first twist length w and is between approximately 0.22 inches and approximately 0.38 inches. For example, the first twist length w may be set to approximately 0.26 inches and the second twist length x may be set to approximately 0.33 inches.

In one embodiment, the first twist length w purposefully modulates from a first average value, such as 0.26 inches. For example, the first twist length could purposefully vary between 0.24 and 0.28 inches along the length of the cable. Likewise, the second twist length could purposefully modulate from a second average value, such as 0.33 inches. For example, the second twist length could purposefully vary between 0.31 and 0.35 inches along the length of the cable.

The third twisted pair 35 would have a third twist length y and the fourth twisted pair 36 would have a fourth twist length of z. In one embodiment, the third twist length y is different from the first, second and fourth twist lengths w, x and z, while the fourth twist length z is different from the first, second and third twist lengths w, x and y. Of course, the third and fourth twisted pairs 35 and 36 could employ a similar twist length modulation, as described in conjunction with the first and second twisted pairs 33 and 34.

Figure 6:
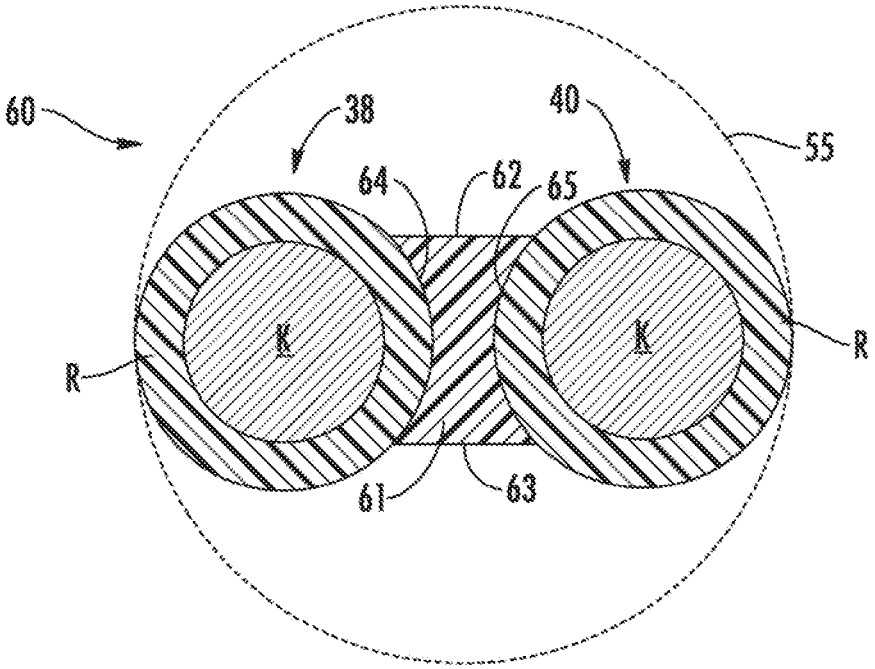
FIG. 6 is a close-up cross sectional view of a twisted pair, having a dielectric tape with an alternative shape, in accordance with a second embodiment of the present invention.

FIG. 6 is a close-up cross sectional view of a twisted pair 60, having a dielectric tape 61 with an alternative shape, in accordance with a second embodiment of the present invention. The dielectric tape 61 has a width which extends approximately perpendicular to an extension length of the twisted pair 60 from a first edge 62 of the dielectric tape 61 to an opposing second edge 63 of the dielectric tape 61. The width, in the embodiment of FIG. 6, is equal to or less than the diameter of the first insulated conductor 38. Less material is used to form the dielectric tape 61 in the embodiment of FIG. 6. This presents advantages in reducing the amount of consumable material in the case of a fire, and in reducing the amount of smoke emitted from the cable 31 in the case of a fire. This structure may also reduce the weight and outer diameter of the cable and improve the flexibility of the cable.

As seen in FIG. 6, the dielectric tape 61 has a cross sectional shape in a direction perpendicular to an extension length of the twisted pair 60, which presents a first recessed portion 64 for seating the first insulated conductor 38 and a second recessed portion 65 for seating the second insulated conductor 40.

The cross sectional shapes of the dielectric tapes 39 and 61 in FIGS. 5 and 6 are mirror symmetrical. However, it is not necessary that the shape be mirror symmetrical in order to achieve many of the advantages of the present invention. Further, the first and second recessed portions 64 and 65 of the dielectric tape 61 in FIG. 6 are semi-circular in shape. However, it is not necessary that the first and second recessed portions 64 and 65 be semi-circular. In fact, the recesses in the dielectric tape 39 of FIG. 5 for receiving the first and second insulated conductors 38 and 40 are not semi-circular in shape. Also, the first and second recessed portions 64 and 65 may include serrations to create pockets of air adjacent to the seated portions of the first and second insulated conductors 38 and 40.

Figure 7:
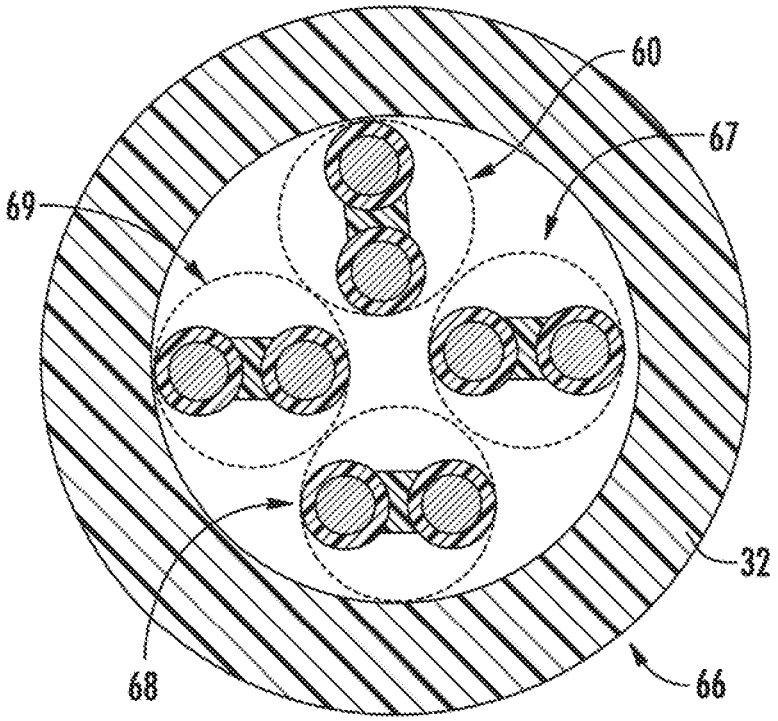
FIG. 7 is a cross sectional view of a twisted pair cable employing twisted pairs in accordance with FIG. 6.

FIG. 7 is a cross sectional view of a twisted pair cable 66 employing the first twisted pair 60 of FIG. 6. The twisted pair cable 66 also includes similarly configured second, third and fourth twisted pairs 67, 68 and 69. The twists of the first, second, third and fourth twisted pairs 60, 67, 68 and 69 occupy respective spaces within the dashed lines 55 (See FIG. 6). In this arrangement, the first through eighth insulated conductors 38, 40, 41, 43, 44, 46, 47 and 49 may contact each other and also may contact the inner wall of the jacket 32.

Figure 8:
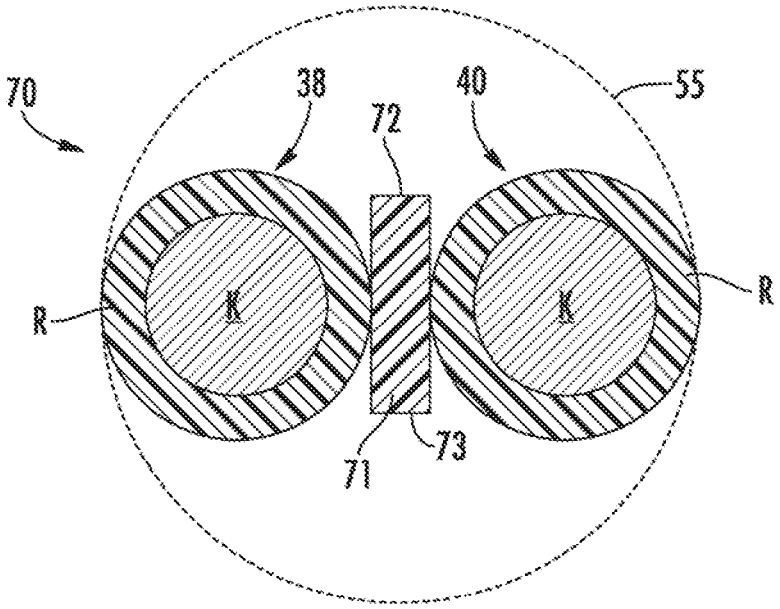
FIG. 8 is a close-up cross sectional view of a twisted pair, having a dielectric tape with an alternative shape, in accordance with a third embodiment of the present invention.

FIG. 8 is a close-up cross sectional view of a twisted pair 70, having a dielectric tape 71 with an alternative shape, in accordance with a third embodiment of the present invention. The dielectric tape 71 has a width which extends approximately perpendicular to an extension length of the twisted pair 70 from a first edge 72 of the dielectric tape 71 to an opposing second edge 73 of the dielectric tape 71. The width, in the embodiment of FIG. 8, is equal to or less than the diameter of the first insulated conductor 38.

The embodiment of FIG. 8 illustrates that the dielectric tape 71 need not have recessed portions 64 and 65 (as shown in FIGS. 5 and 6) to seat the insulated conductors 38 and 40. Rather, the dielectric tape 71 may be formed as a generally flat member. The dielectric tape 71 will remain between the first and second insulated conductors 38 and 40 due to the frictional forces created during the twisting operation, when the twisted pair 70 is formed.

Figure 8A:
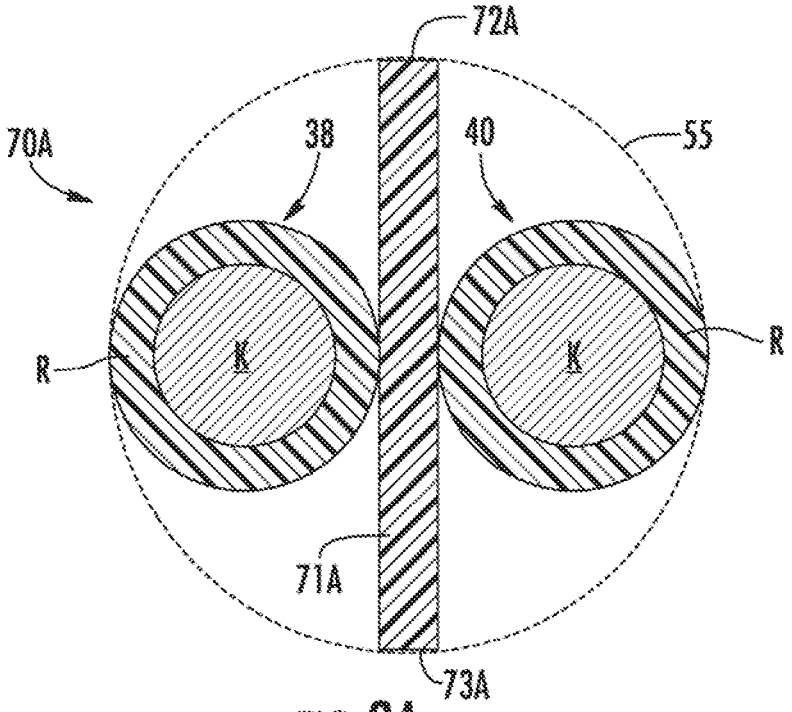
FIG. 8A is a close-up cross sectional view of a twisted pair, having a dielectric tape with an alternative shape, in accordance with a fourth embodiment of the present invention.

FIG. 8A is a close-up cross sectional view of a twisted pair 70A, having a dielectric tape 71A with an alternative shape, in accordance with a fourth embodiment of the present invention. The dielectric tape 71A has a width which extends approximately perpendicular to an extension length of the twisted pair 70A from a first edge 72A of the dielectric tape 71A to an opposing second edge 73A of the dielectric tape 71A. The width, in the embodiment of FIG. 8A, is equal to or slightly less than (e.g., two to four mils less than) the diameter of the first insulated conductor 38 plus the diameter of the second insulated conductor 40 plus a thickness of the dielectric tape 71A.

The embodiment of FIG. 8A illustrates that the dielectric tape 71A may be a generally flat member having a width which is approximately equal the diameter of the first insulated conductor 38 plus the diameter of the second insulated conductor 40 plus a thickness of the dielectric tape 71A, such as about seventy-two mils plus or minus about three mils.

Figure 8B:
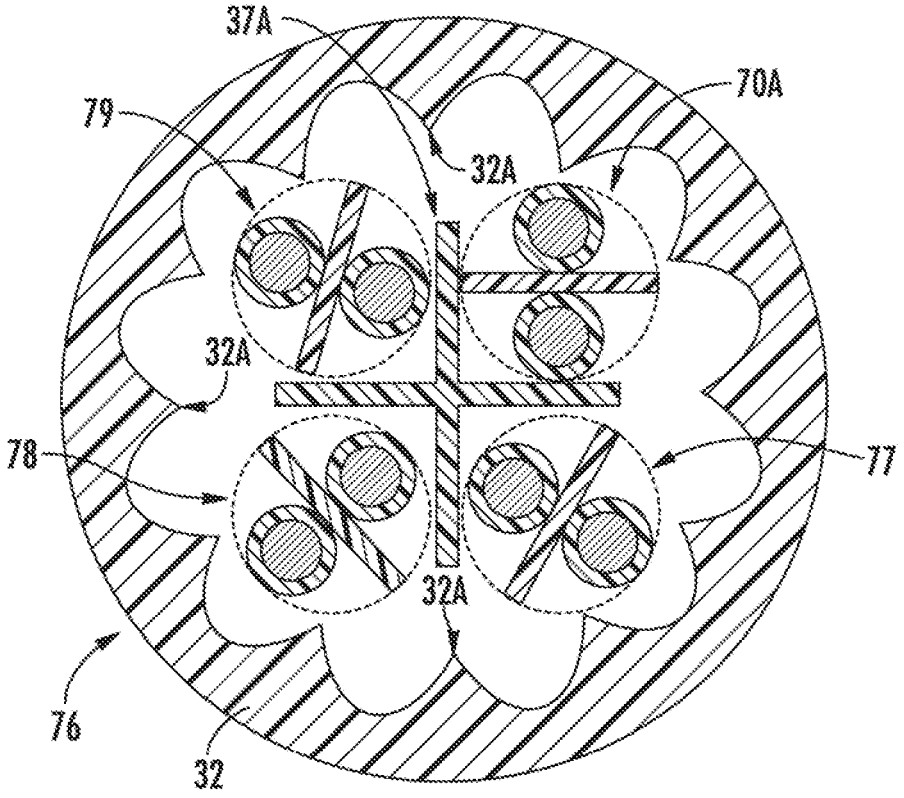
FIG. 8B is a cross sectional view of a twisted pair cable employing twisted pairs in accordance with FIG. 8A.

FIG. 8B is a cross sectional view of a twisted pair cable 76 employing the first twisted pair 70A of FIG. 8A, in accordance with a preferred embodiment of the present invention. The twisted pair cable 76 also includes similarly configured second, third and fourth twisted pairs 77, 78 and 79. The twists of the first, second, third and fourth twisted pairs 70A, 77, 78 and 79 occupy respective spaces within the dashed lines 55 (See FIG. 8A). In this arrangement, the first through eighth insulated conductors 38, 40, 41, 43, 44, 46, 47 and 49 may contact a plus-shaped separator 37A (sometimes referred to as an isolator, a flute or a crossweb) and also may contact inner ends of projections or fins 32A on the inner wall of the jacket 32. FIG. 8B shows twelve projections 32A, however more or fewer projections may be included, with the goal being to hold the core of twisted pairs 70A, 77, 78 and 79 in the center of the cable 76 while creating air pockets around the perimeter of the core of twisted pairs.

Figure 9:
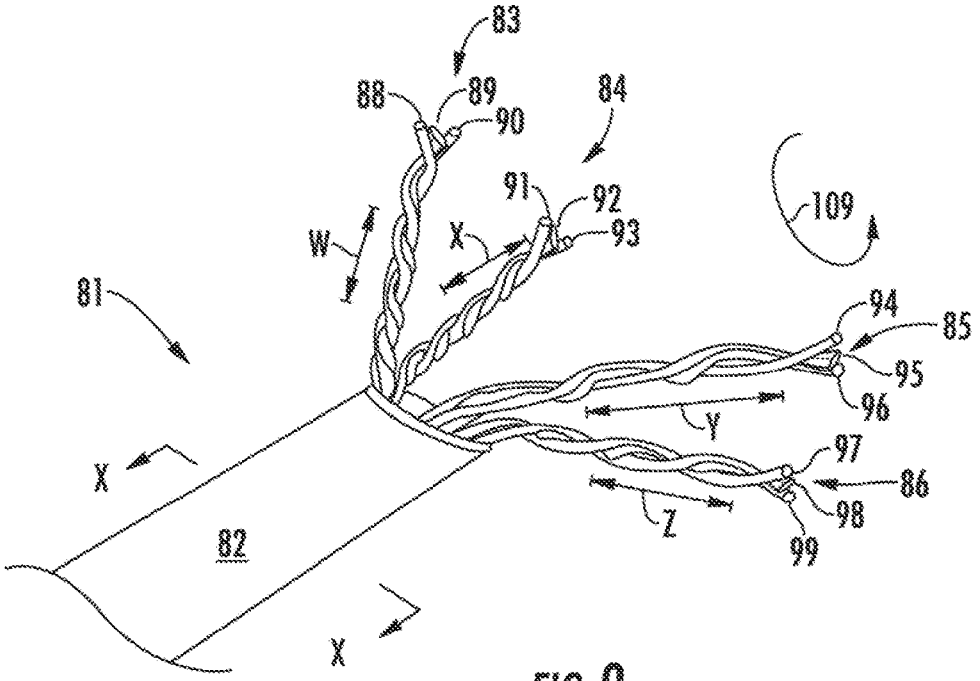
FIG. 9 is a perspective view of a twisted pair cable, in accordance with a fifth embodiment of the present of the present invention.
Figure 10:
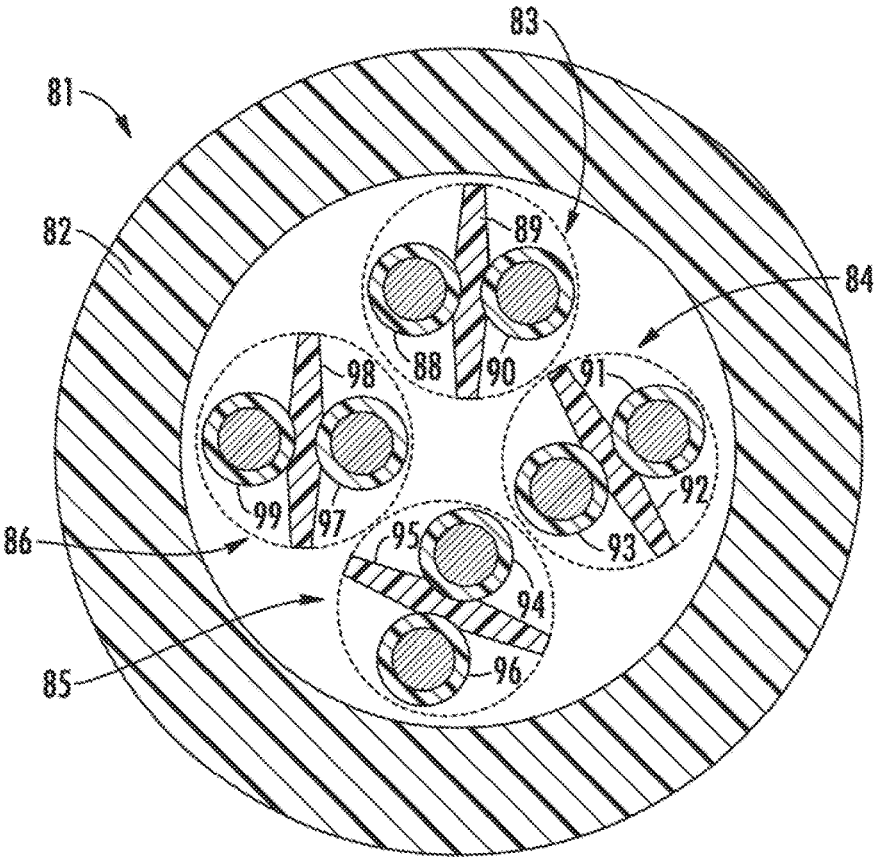
FIG. 10 is a cross sectional view of the twisted pair cable of FIG. 9 taken along line X-X.

FIG. 9 is a perspective view of a twisted pair cable 81, in accordance with a fifth embodiment of the present invention. FIG. 10 is a cross sectional view of the cable 81 taken along line X-X in FIG. 9. The cable 81 includes a jacket 82 formed around and surrounding first, second, third and fourth twisted pairs 83, 84, 85 and 86, respectively.

The fifth embodiment of the invention, as illustrated in FIGS. 9 and 10, does not include a separator 37. However, pair separators (sometimes referred to as tapes, isolators, flutes or crosswebs) may optionally be included, if desired.

As best seen in the cross sectional view of FIG. 10, the first twisted pair 83 includes a first insulated conductor 88, a first dielectric tape 89, and a second insulated conductor 90. The first insulated conductor 88 is twisted with the second insulated conductor 90, in a helical fashion, with the first dielectric tape 89 residing between the first insulated conductor 88 and the second insulated conductor 90.

The second twisted pair 84 includes a third insulated conductor 91, a second dielectric tape 92, and a fourth insulated conductor 93. The third insulated conductor 91 is twisted with the fourth insulated conductor 93, in a helical fashion, with the second dielectric tape 92 residing between the third insulated conductor 91 and the fourth insulated conductor 93.

The third twisted pair 85 includes a fifth insulated conductor 94, a third dielectric tape 95, and a sixth insulated conductor 96. The fifth insulated conductor 94 is twisted with the sixth insulated conductor 96, in a helical fashion, with the third dielectric tape 95 residing between the fifth insulated conductor 94 and the sixth insulated conductor 96.

The fourth twisted pair 86 includes a seventh insulated conductor 97, a fourth dielectric tape 98, and an eighth insulated conductor 99. The seventh insulated conductor 97 is twisted with the eighth insulated conductor 99, in a helical fashion, with the fourth dielectric tape 98 residing between the seventh insulated conductor 97 and the eighth insulated conductor 99.

Figure 11:
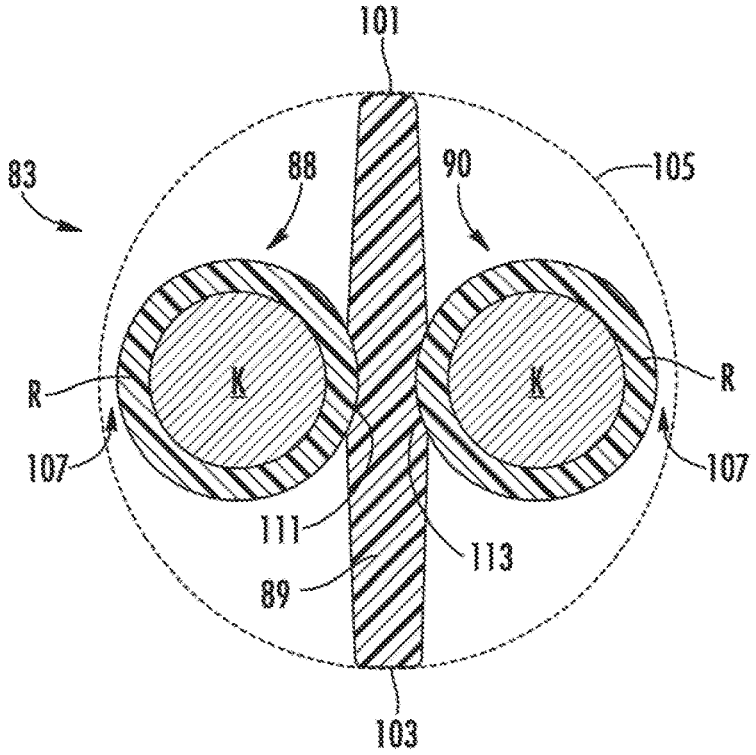
FIG. 11 is a close-up cross sectional view of a twisted pair from FIG. 10.

FIG. 11 is a close-up view of the first twisted pair 83, which is similarly constructed to the second, third and fourth twisted pairs 84, 85 and 86. Like the first embodiment of FIGS. 3-5, each of the first through eighth insulated conductors 88, 90, 91, 93, 94, 96, 97 and 99 is formed by a conductor K surrounded by a layer of dielectric insulating material R. Also, the insulating material R may have a radial thickness of about seven mils or less, more preferably about five mils or less.

As best seen in FIG. 11, the first dielectric tape 89 has a first width which extends approximately perpendicular to an extension length of the first twisted pair 83 from a first edge 101 of the first dielectric tape 89 to a second edge 103 of the first dielectric tape 89. The first width is greater than a diameter of the first insulated conductor 88 plus a diameter of the second insulated conductor 90 plus a thickness of the first dielectric tape 89, wherein the thickness is measured by the spacing created between the first and second insulated conductors 88 and 90. A typical spacing might be between four to twelve mils, such as about eight mils or about ten mils. By this arrangement, the twists of the first twisted pair 83 occupy a space within the dashed line 105, which is circumscribed by the helical twisting of the first and second edges 101 and 103 of the first dielectric tape 89. In this arrangement, the first through eighth insulated conductors 88, 90, 91, 93, 94, 96, 97 and 99 do not contact each other and also do not contact the inner wall of the jacket 82.

Rather, a small air pocket 107 is maintained around the outer perimeter of the dielectric insulating material R. Hence, the first insulated conductor 88 would be spaced from the inner wall of the jacket 82 by a first minimum distance, where the first minimum distance could be fixed in the range of one to twenty mils, such as two mils or four mils. Moreover, the first insulated conductor 88 would be spaced from any other insulated conductor of another twisted pair 84, 85 or 86 of the cable 81 by a second minimum distance. The second minimum distance would equal twice the first minimum distance, because the small air pocket 107 of the first twisted pair 83 would be added to the small air pocket 107 of the other twisted pair 84, 85 or 86.

As in the first embodiment of FIGS. 3-5, the first through fourth twisted pairs 83, 84, 85 and 86 may be stranded together in the direction 109 (see the arrow in FIG. 9) to form a stranded core. In one embodiment, the core strand direction 109 is opposite to the pair twist directions of the first through fourth twisted pairs 83, 84, 85 and 86. However, this is not a necessary feature. The core strand length and pair twist lengths w, x, y and z may be tight, as described in conjunction with FIGS. 3-5, and may optionally be modulated.

As best seen in the cross sectional view of FIG. 11, the first dielectric tape 89 includes first and second recesses 111 and 113 to seat the first and second insulated conductors 88 and 90. The first and second recesses 111 and 113 may assist in properly positioning the three parts 88, 89 and 90 of the first twisted pair 83 during a manufacturing process, and may also assist in keeping the three parts 88, 89 and 90 of the first twisted pair 83 in place during use of the cable 81 (e.g., pulling of the cable through conduits or ductwork). However, many advantages of the invention may be achieved without the recesses 111 and 113, as will be seen in FIG. 12.

Figure 29:
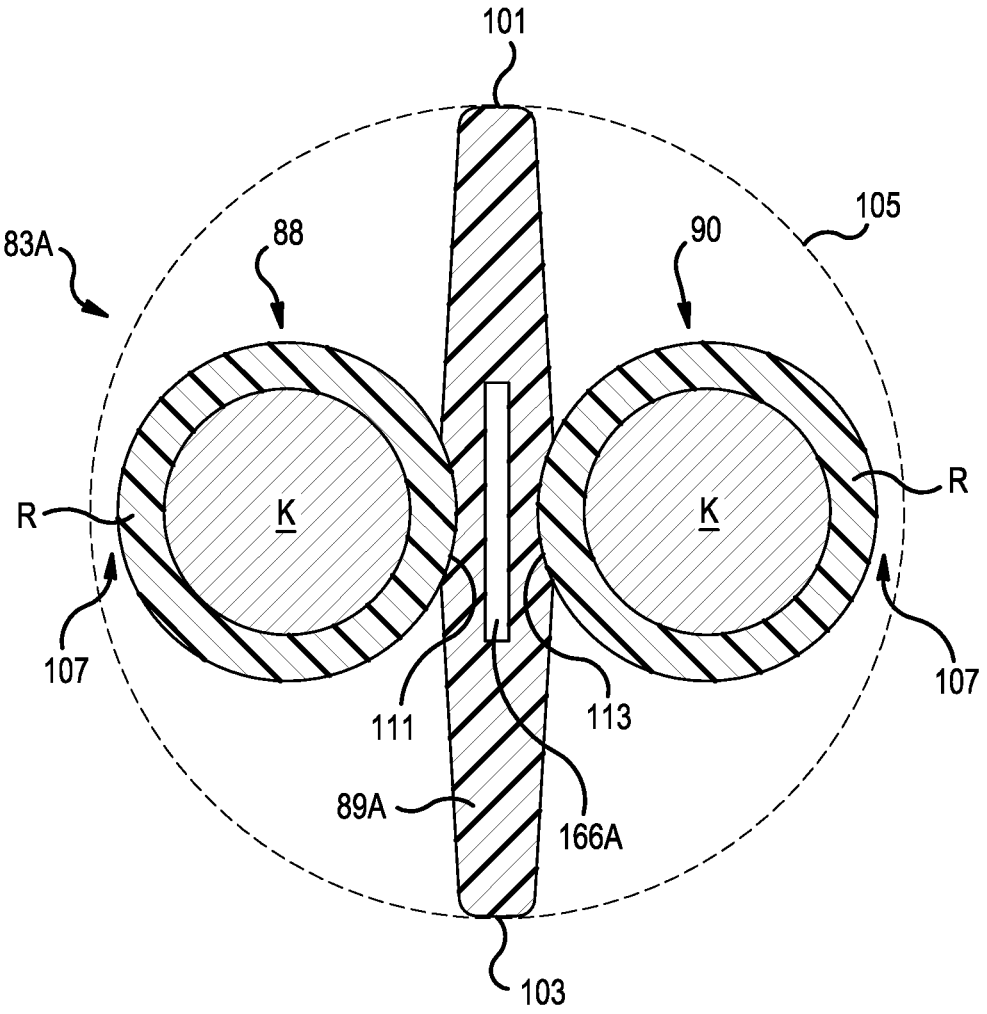
FIG. 29 is a close-up cross sectional view of a twisted pair, having a dielectric tape with an alternative configuration, in accordance with a twenty-second embodiment of the present invention.

Further, as best seen in FIG. 29, the first dielectric tape 89A may be modified so that an area residing between the first and second insulated conductors 88 and 90 includes a hollow core filled with air 166A. The air 166A lowers the dielectric constant of the portion of the first dielectric tape 89A residing between the first and second insulated conductors 88 and 90. The hollow core may extend the entire length of the first dielectric tape 89A, resulting in a "straw-like" structure. Alternatively, support structures may be formed at intervals along the length of the first dielectric tape 89A to form closed-cell air pockets, each having a short length, such as ½ inch, one inch, two inches, etc. Alternatively, one or more support structures may be formed within the hollow core, which extend along the length of the first dielectric tape 89A and connect between the lateral walls of the hollow core to resist crushing of the hollow core during the twisting of the first twisted pair 83A.

Figure 12:
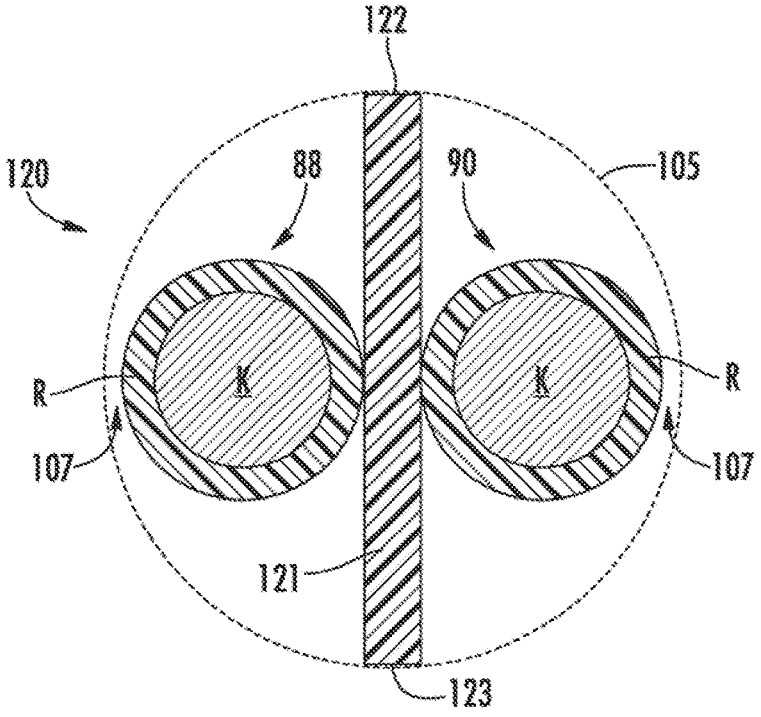
FIG. 12 is a close-up cross sectional view of a twisted pair, having a dielectric tape with an alternative shape, in accordance with a sixth embodiment of the present invention.

FIG. 12 is a close-up cross sectional view of a twisted pair 120, having a dielectric tape 121 with an alternative shape, in accordance with a sixth embodiment of the present invention. The dielectric tape 121 has a width which extends approximately perpendicular to an extension length of the twisted pair 120 from a first edge 122 of the dielectric tape 121 to a second edge 123 of the dielectric tape 121. Like the embodiment of FIGS. 9-11, the width of the dielectric tape 121 is greater than the diameter of the first insulated conductor 88 plus the diameter of the second insulated conductor 90 plus a thickness of the first dielectric tape 121. The dielectric tape 121 may be formed as a generally flat member. The dielectric tape 121 will remain between the first and second insulated conductors 88 and 90 due to the frictional forces created during the twisting operation, when the twisted pair 120 is formed.

Figure 13:
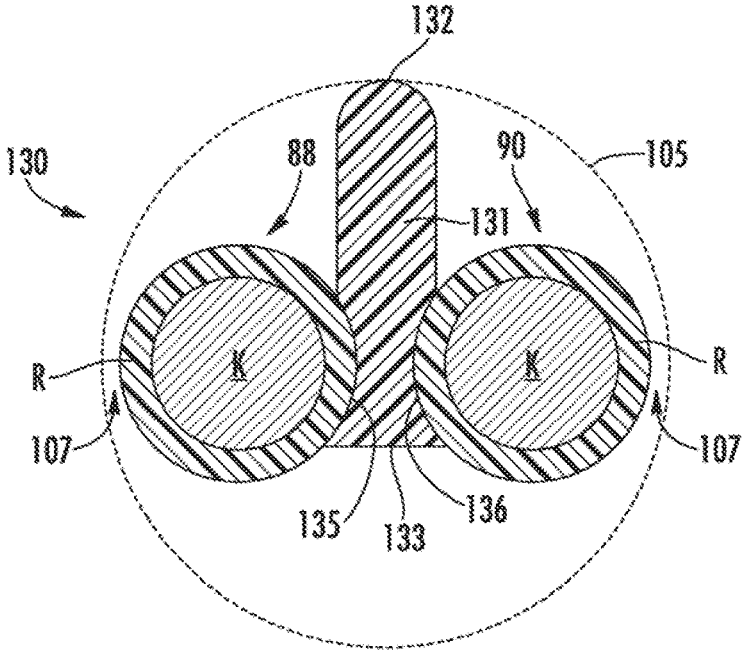
FIG. 13 is a close-up cross sectional view of a twisted pair, having a dielectric tape with an alternative shape, in accordance with a seventh embodiment of the present invention.

FIG. 13 is a close-up cross sectional view of a twisted pair 130, having a dielectric tape 131 with an alternative shape, in accordance with a seventh embodiment of the present invention. The dielectric tape 131 has a width which extends approximately perpendicular to an extension length of the twisted pair 130 from a first edge 132 of the dielectric tape 131 to a second edge 133 of the dielectric tape 131. The dielectric tape 131 has a cross sectional shape in a direction perpendicular to an extension length of the twisted pair 130, which presents a first recessed portion 135 for seating the first insulated conductor 88 and a second recessed portion 136 for seating the second insulated conductor 90.

Figure 14:
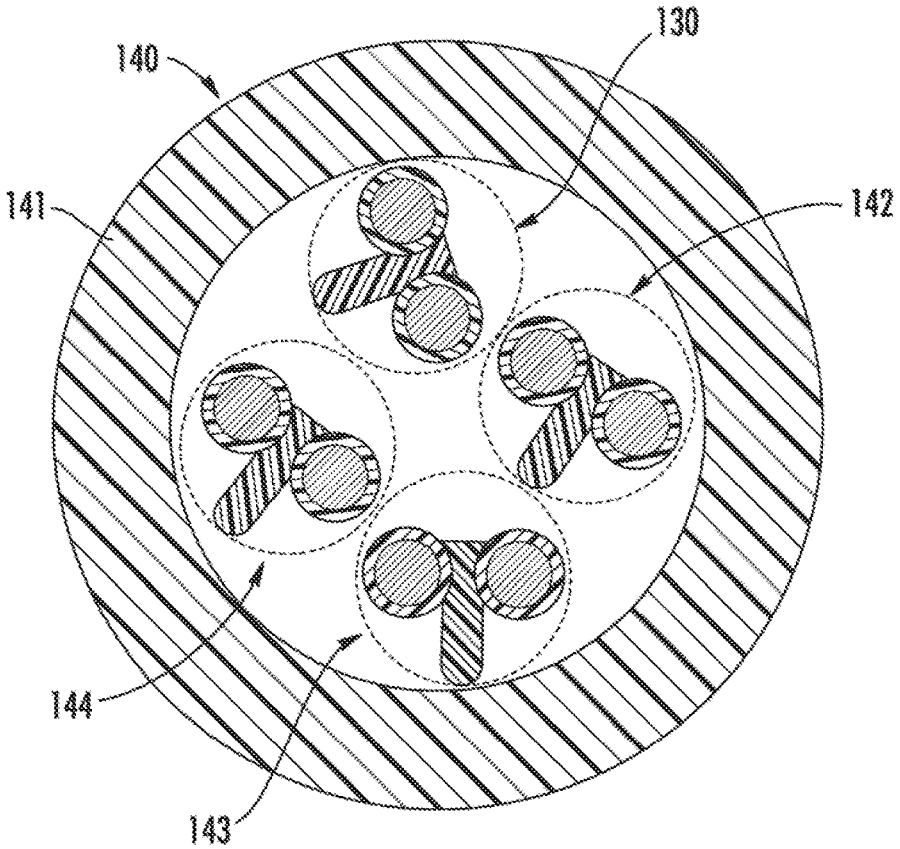
FIG. 14 is a cross sectional view of a twisted pair cable employing twisted pairs in accordance with FIG. 13.

The first edge 132 of the first dielectric tape 131 in FIG. 13 will circumscribe an area 105 around the first twisted pair 130, which includes the small air gaps 107. However, the width of the first dielectric tape 131 is only slightly more than one-half the width of the dielectric tape 89 in the embodiment of FIGS. 9-11. FIG. 14 illustrates a cable 140 with a jacket 141, wherein the first twisted pair 130 is stranded with three other similarly-configured twisted pairs, namely a second twisted pair 142, a third twisted pair 143 and a fourth twisted pair 144.

Some of the advantages of the seventh embodiment of FIGS. 13 and 14 over the fifth embodiment of FIGS. 9-11 are that the material cost, and the weight of the cable 140 can be reduced. Yet, the seventh embodiment of FIGS. 13 and 14 will still create the small air gaps 107, primarily due to the tight twist lengths of the first through fourth twisted pairs 130, 142, 143 and 144.

Figure 15:
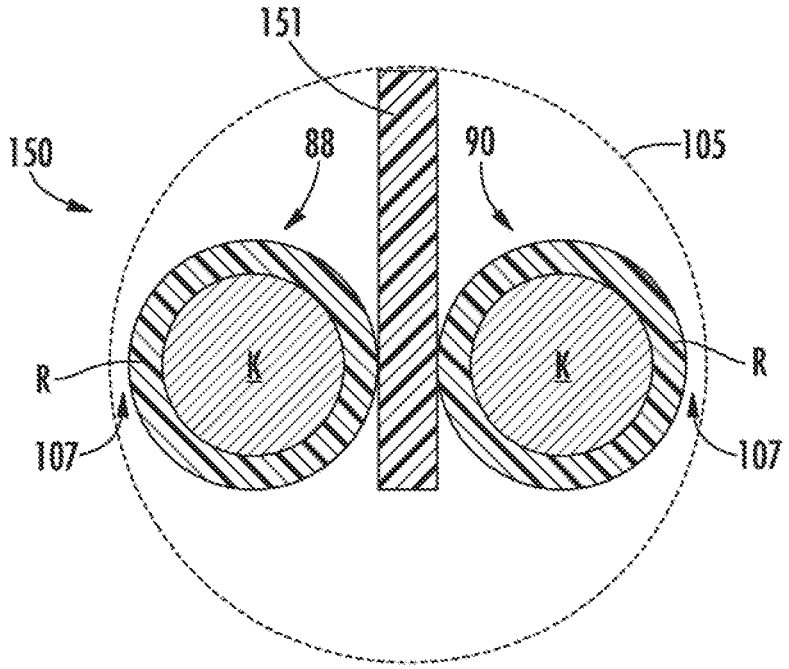
FIG. 15 is a close-up cross sectional view of a twisted pair, having a dielectric tape with an alternative shape, in accordance with a eighth embodiment of the present invention.

FIG. 15 is a close-up cross sectional view of a twisted pair 150, having a dielectric tape 151 with an alternative shape, in accordance with a eighth embodiment of the present invention. The eighth embodiment is identical to the seventh embodiment of FIGS. 13 and 14, except that the dielectric tape 151 does not have recessed seats 135 and 136 to seat the first and second insulated conductors 88 and 90. Rather, the dielectric tape 151 has a substantially rectangular cross sectional shape. The dielectric tape 151 will remain between the first and second insulated conductors 88 and 90 due to the frictional forces created during the twisting operation, when the twisted pair 150 is formed.

Figure 16:
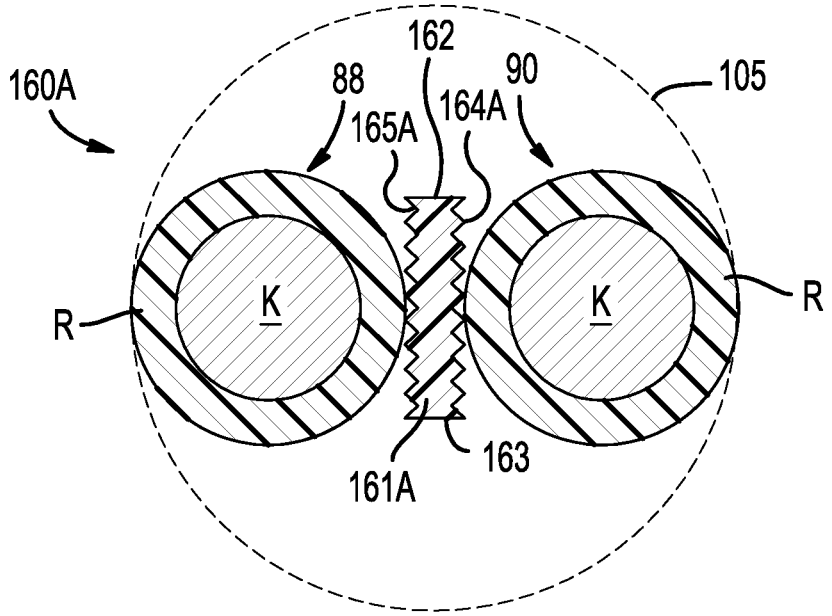
FIG. 16 is a close-up cross sectional view of a twisted pair, having a dielectric tape with an alternative shape, in accordance with a ninth embodiment of the present invention.

FIG. 16 is a close-up cross sectional view of a twisted pair 160A, having a dielectric tape 161A with an alternative configuration, in accordance with a ninth embodiment of the present invention. The ninth embodiment includes a first insulated conductor 88, a first dielectric tape 161A, and a second insulated conductor 90. The first insulated conductor 88 is twisted with the second insulated conductor 90 with the first dielectric tape 161A residing between the first insulated conductor 88 and the second insulated conductor 90 to form the twisted pair 160A. The dielectric tape 161A has a width which extends approximately perpendicular to an extension length of the twisted pair 160A from a first edge 162 of the dielectric tape 161A to an opposing second edge 163 of the dielectric tape 161A. The width, in the embodiment of FIG. 16, is equal to or less than the diameter of the first insulated conductor 88.

The embodiment of FIG. 16 is similar in most regards to the embodiment of FIG. 8, but illustrates that the dielectric tape 161A may include a plurality of ridges 164A and valleys 165A on at least a first side of the first dielectric tape 161A facing to the first insulated conductor 88. In a preferred embodiment, the first dielectric tape 161A includes a plurality of ridges 164A and valleys 165A on both the first side of the first dielectric tape 161A facing to the first insulated conductor 88 and on a second side of the first dielectric tape 161A facing to the second insulated conductor 90.

The insulation layers R of the first and second insulated conductors 88 and 90 engage the ridges 164A, so that the valleys 165A introduces air immediately adjacent to the insulation layers R of the first and second insulated conductors 88 and 90. Air has a dielectric constant of approximately 1.0, and the introduction of air close to the insulation layers R improves the overall dielectric constant of the first dielectric tape 161A, e.g., reduces the overall dielectric constant of the first dielectric tape 161A.

In FIG. 16, the plurality of ridges 164A are shaped in the form of angled peaks, and the plurality of valleys 165A are shaped in the form of angled valleys. The actual shapes of the ridges and/or valleys are not critical. Rather, an important aspect is the introduction of air into the first and second surfaces of the first dielectric tape 161A, which contact the first and second insulated conductors 88 and 90.

Figure 17:
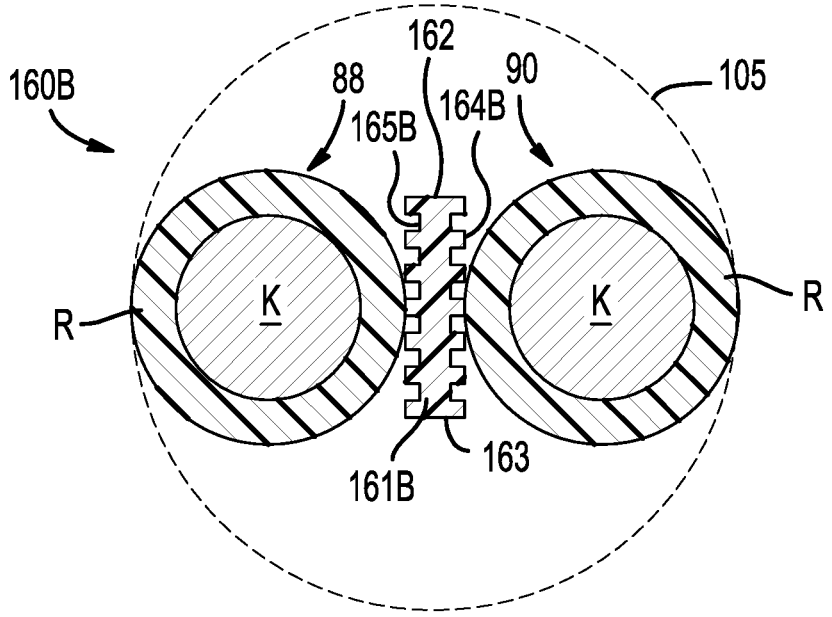
FIG. 17 is a close-up cross sectional view of a twisted pair, having a dielectric tape with an alternative shape, in accordance with a tenth embodiment of the present invention.

FIG. 17 is a close-up cross sectional view of a twisted pair 160B, having a dielectric tape 161B with an alternative configuration, in accordance with a tenth embodiment of the present invention. The tenth embodiment is the same as the ninth embodiment, except that the plurality of ridges 164B are shaped in the form of rectangular protrusions, and the plurality of valleys 165B are shaped in the form of rectangular recesses.

Figure 18:
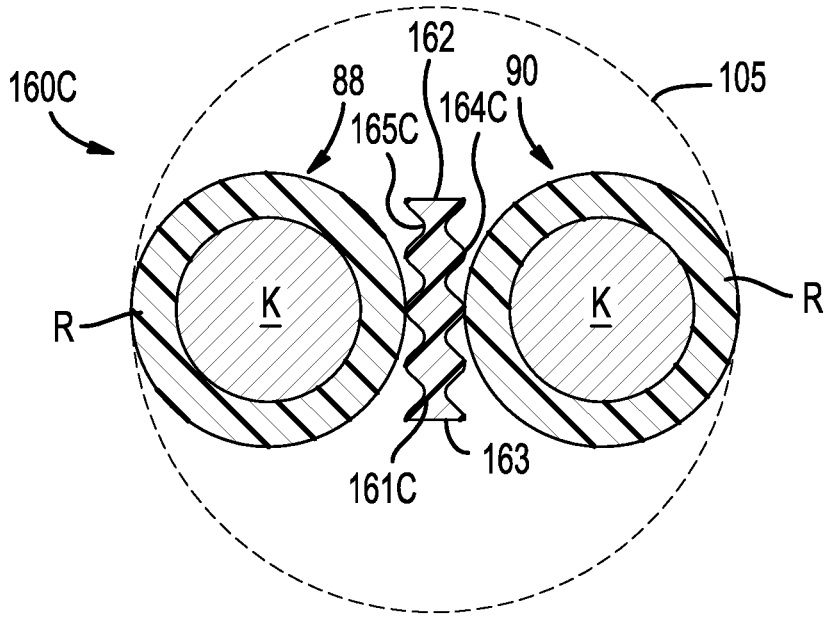
FIG. 18 is a close-up cross sectional view of a twisted pair, having a dielectric tape with an alternative shape, in accordance with an eleventh embodiment of the present invention.

FIG. 18 is a close-up cross sectional view of a twisted pair 160C, having a dielectric tape 161C with an alternative configuration, in accordance with an eleventh embodiment of the present invention. The eleventh embodiment is the same as the ninth and tenth embodiments, except that the plurality of ridges 164C are shaped in the form of curved protrusions, and the plurality of valleys 165C are shaped in the form of curved recesses.

Figure 19:
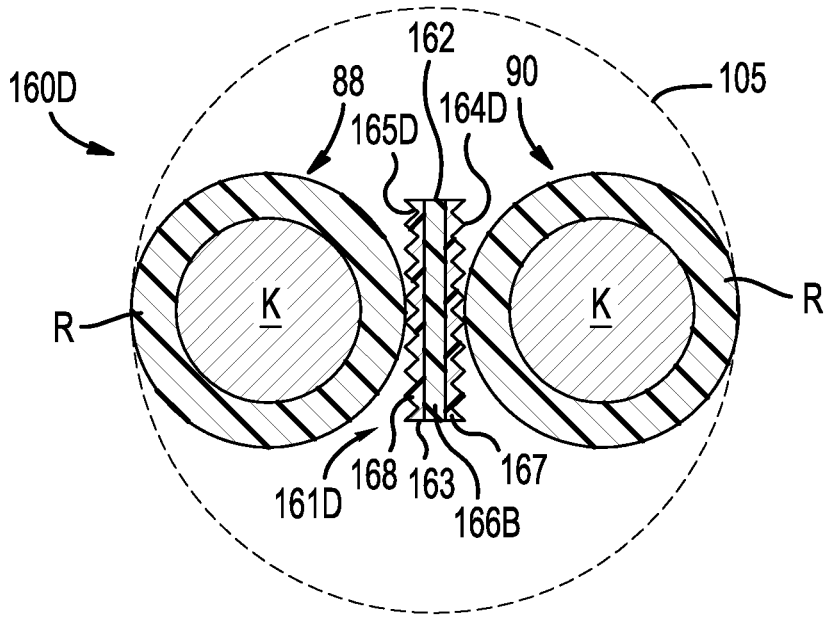
FIG. 19 is a close-up cross sectional view of a twisted pair, having a dielectric tape with an alternative configuration, in accordance with a twelfth embodiment of the present invention.

FIG. 19 is a close-up cross sectional view of a twisted pair 160D, having a dielectric tape 161D with an alternative configuration, in accordance with a twelfth embodiment of the present invention. The twelfth embodiment is the same as the ninth embodiment, in that the plurality of ridges 164D are shaped in the form of angled peaks, and the plurality of valleys 165D are shaped in the form of angled valleys. However, in the twelfth embodiment, the first dielectric tape 161D is formed of at least two different materials. A first side 168 of the first dielectric tape 161D, facing to the first insulated conductor 88, and a second side 167 of the first dielectric tape 161D, facing to the second insulated conductor 90, are formed of a first dielectric material. A mid-portion 166B of the first dielectric tape 161D is formed of a second dielectric material. A first dielectric constant of the first material is different from a second dielectric constant of the second material. In a preferred embodiment, the second dielectric constant is lower than the first dielectric constant. The second material improves the overall dielectric constant of the first dielectric tape 161D, e.g., reduces the overall dielectric constant of the first dielectric tape 161D.

Figure 20:
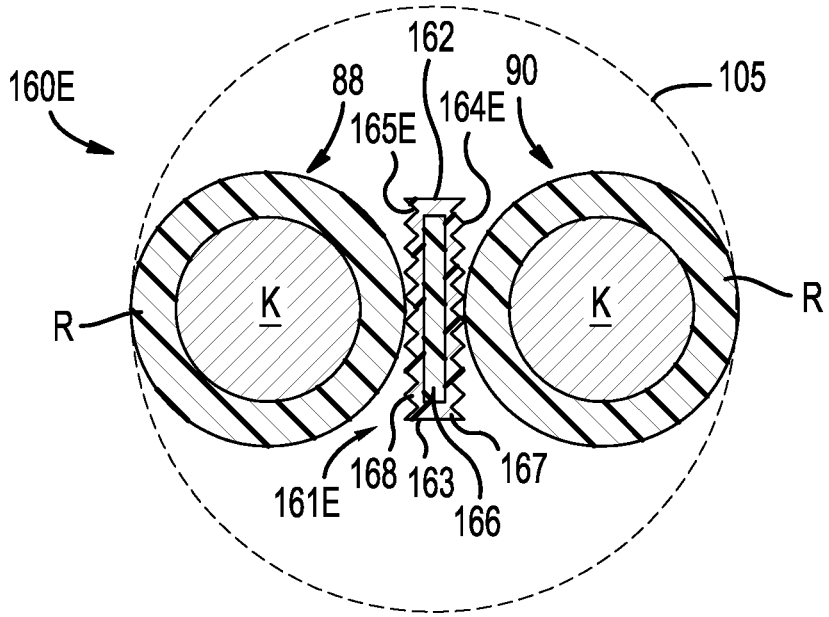
FIGS. 20 and 20A are close-up cross sectional views of a twisted pair, having a dielectric tape with an alternative configuration, in accordance with a thirteenth embodiment of the present invention.
Figure 20A:
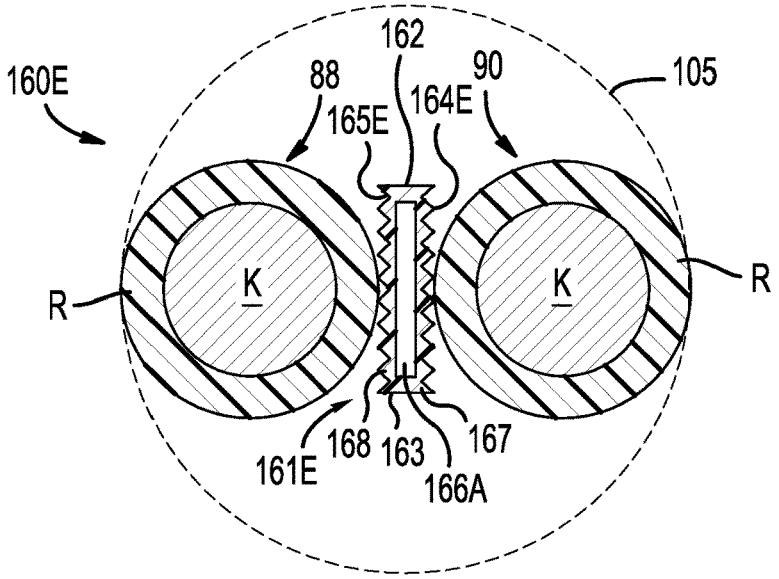

FIGS. 20 and 20A are close-up cross sectional views of a twisted pair 160E, having a dielectric tape 161E with an alternative configuration, in accordance with a thirteenth embodiment of the present invention. The thirteenth embodiment is the same as the twelfth embodiment, in that the plurality of ridges 164E are shaped in the form of angled peaks, and the plurality of valleys 165E are shaped in the form of angled valleys. However, in the thirteenth embodiment, the construction of the first dielectric tape 161E is different. In FIG. 20, the first side 168 of the first dielectric tape 161E, facing to the first insulated conductor 88 is attached to the second side 167 of the first dielectric tape 161E, facing to the second insulated conductor 90 along the first edge 162 and along the second edge 163.

Figure 20B:
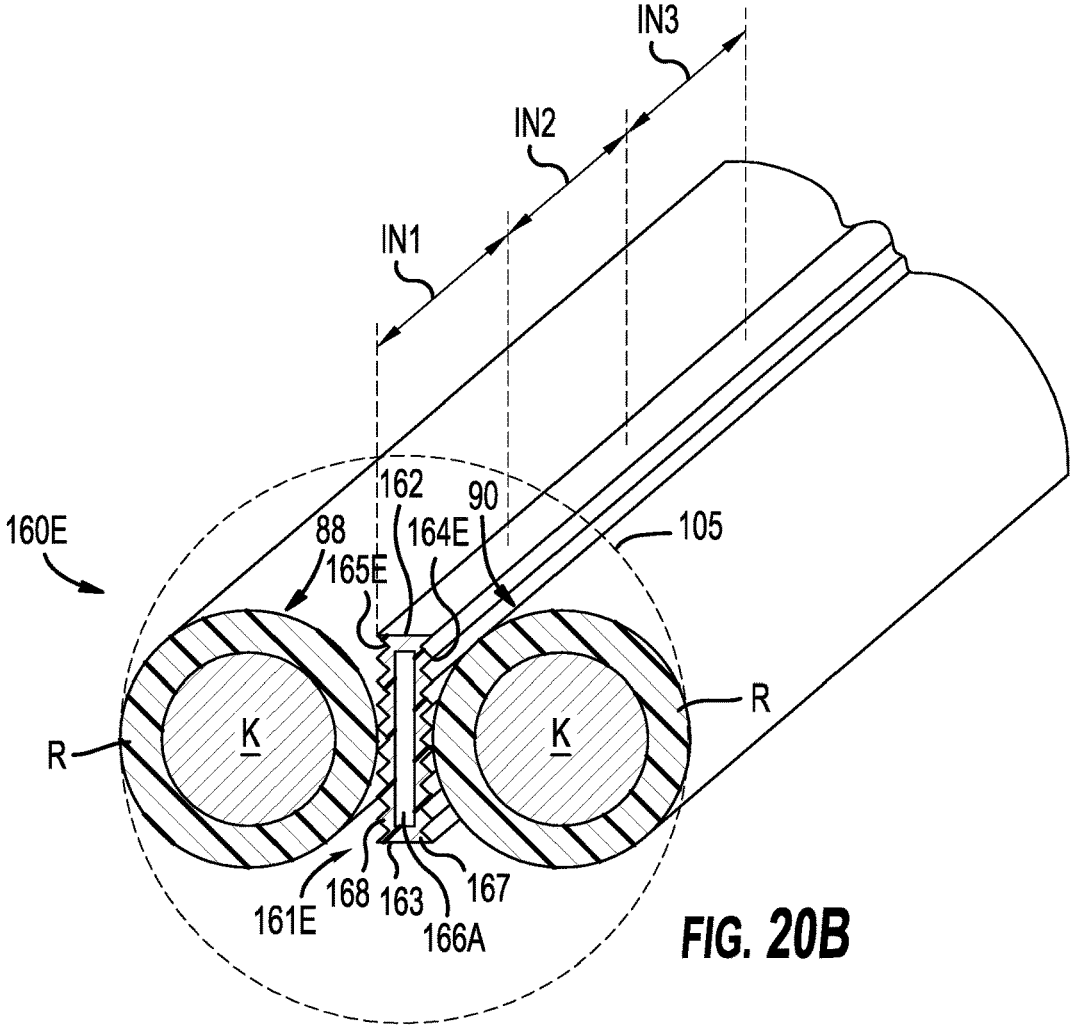
FIG. 20B is a perspective view of the twisted pair of FIG. 20A, showing the interval of the closed-cell air pockets.

Like the embodiment depicted in, and described in relation to FIG. 5A, the first dielectric tape 161E has a hollow core which may possess a gas (See FIG. 20A), like air 166A (with a dielectric constant of about 1.0) or, as depicted in FIG. 20, a foamed insulation material 166 (with a dielectric constant approaching 1.0). Again, the foamed insulation material 166 would have a lower dielectric constant than a material used to form the remaining portions of the first dielectric tape 161E. By filling the hollow core with a gas or material with a lower dielectric constant than a material used to form the remaining portions of the first dielectric tape 161E, the overall dielectric constant of the first dielectric tape 161E may be reduced. The hollow core may extend the entire length of the dielectric tape 161E, resulting in a "straw-like" structure. Alternatively, support structures may be formed at intervals IN1, IN2, IN3, . . . along the length of the dielectric tape 161E to form closed-cell air pockets, each having a short length, such as ½ inch, one inch, two inches, etc., as graphically shown, not to scale, in FIG. 20B. Alternatively, one or more support structures may be formed within the hollow core, which extend along the length of the dielectric tape 161E and connect between the first and second sides 168 and 167 of the hollow core to resist crushing of the hollow core during the twisting of the twisted pair 160E.

Figure 21:
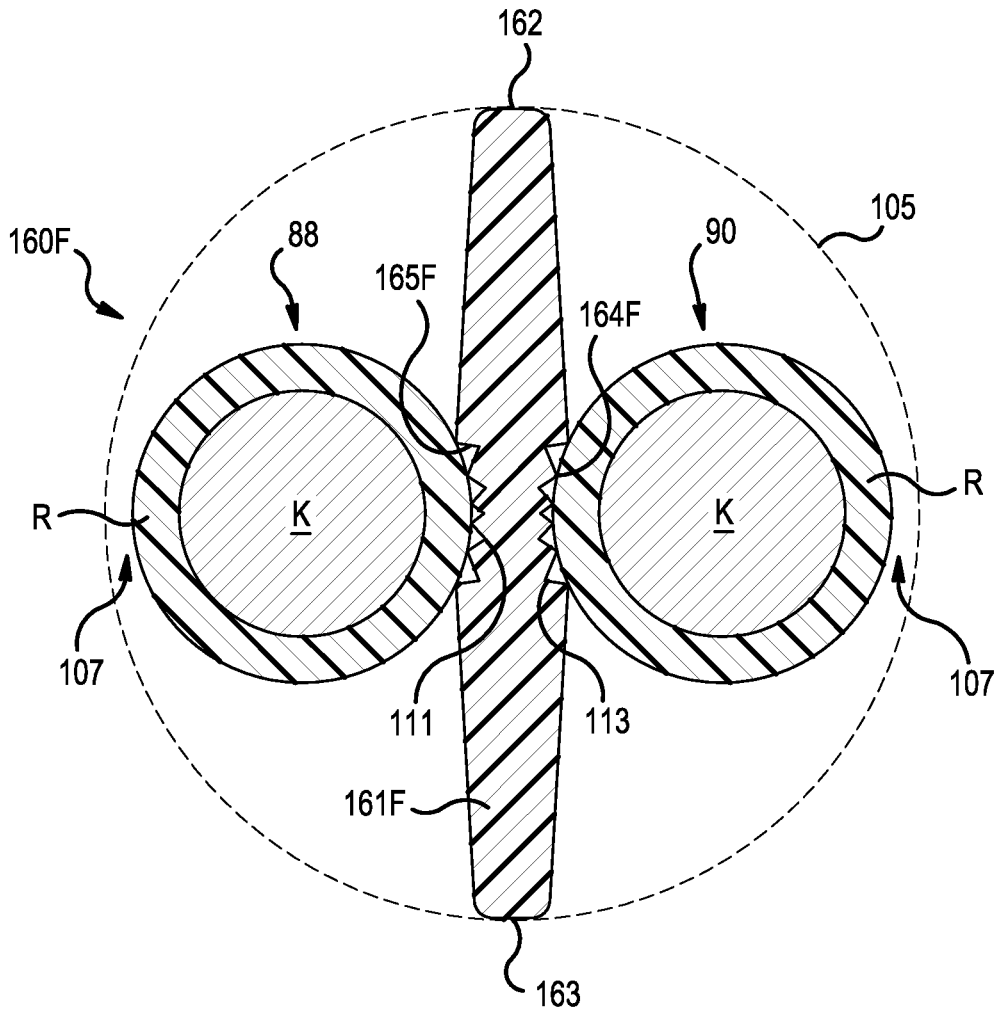
FIG. 21 is a close-up cross sectional view of a twisted pair, having a dielectric tape with an alternative configuration, in accordance with a fourteenth embodiment of the present invention.

FIG. 21 is a close-up cross sectional view of a twisted pair 160F, having a first dielectric tape 161F with an alternative configuration, in accordance with a fourteenth embodiment of the present invention. The fourteenth embodiment includes a first insulated conductor 88, a first dielectric tape 161F, and a second insulated conductor 90. The first insulated conductor 88 is twisted with the second insulated conductor 90 with the first dielectric tape 161F residing between the first insulated conductor 88 and the second insulated conductor 90 to form the twisted pair 160F. The first dielectric tape 161F has a width which extends approximately perpendicular to an extension length of the twisted pair 160F from a first edge 162 of the first dielectric tape 161F to an opposing second edge 163 of the first dielectric tape 161F. The width, in the embodiment of FIG. 21, is greater than the diameter of the first insulated conductor 88 plus the diameter of the second insulated conductor 90 plus a thickness of the first dielectric tape 161F, located between the first and second insulated conductors 88 and 90. The length of the first dielectric tape 161F creates the small air pocket 107, as discussed in connection with FIG. 11, above.

The embodiment of FIG. 21 is similar in most regards to the embodiment of FIG. 11, but illustrates that the first dielectric tape 161F may include a plurality of ridges 164F and valleys 165F in at least the first recess 111 which seats the first insulated conductor 88. In a preferred embodiment, the first dielectric tape 161F includes a plurality of ridges 164F and valleys 165F in both the first recess 111, which seats the first insulated conductor 88, and in the second recess 113, which seats the second insulated conductor 90.

The insulation layers R of the first and second insulated conductors 88 and 90 engage the ridges 164F, so that the valleys 165F introduce air immediately adjacent to the insulation layers R of the first and second insulated conductors 88 and 90. Air has a dielectric constant of approximately 1.0, and the introduction of air close to the insulation layers R improves the overall dielectric constant of the first dielectric tape 161F, e.g., reduces the overall dielectric constant of the first dielectric tape 161F.

Figure 22:
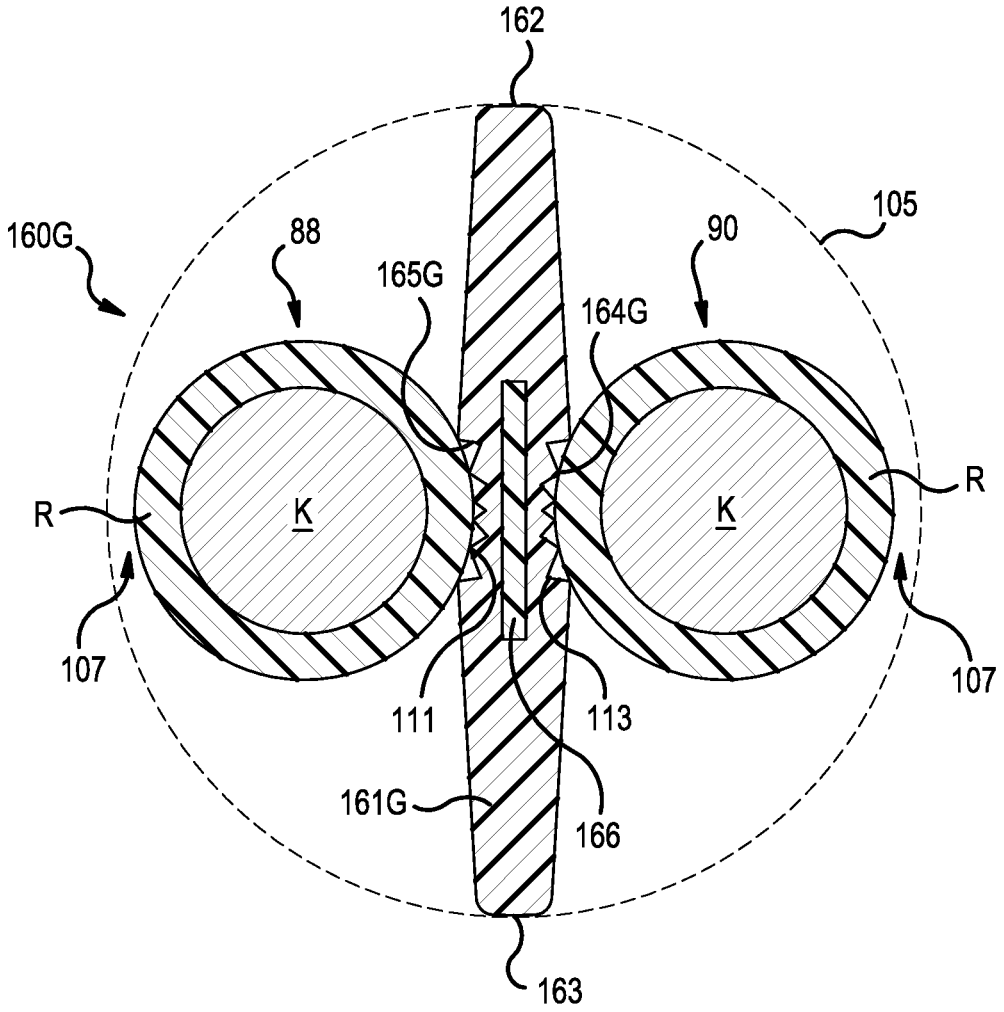
FIG. 22 is a close-up cross sectional view of a twisted pair, having a dielectric tape with an alternative configuration, in accordance with a fifteenth embodiment of the present invention.

FIG. 22 is a close-up cross sectional view of a twisted pair 160G, having a first dielectric tape 161G with an alternative configuration, in accordance with a fifteenth embodiment of the present invention. The fifteenth embodiment is the same as the fourteenth embodiment, except that the first dielectric tape 161G includes a hollow core possessing the foamed insulation material 166. The foamed insulation material 166 is formed of a material with a lower dielectric constant per unit volume, as compared to the other materials used to form the first dielectric tape 161G, which improves the overall dielectric constant of the first dielectric tape 161G, e.g., reduces the overall dielectric constant of the first dielectric tape 161G.

Figure 23:
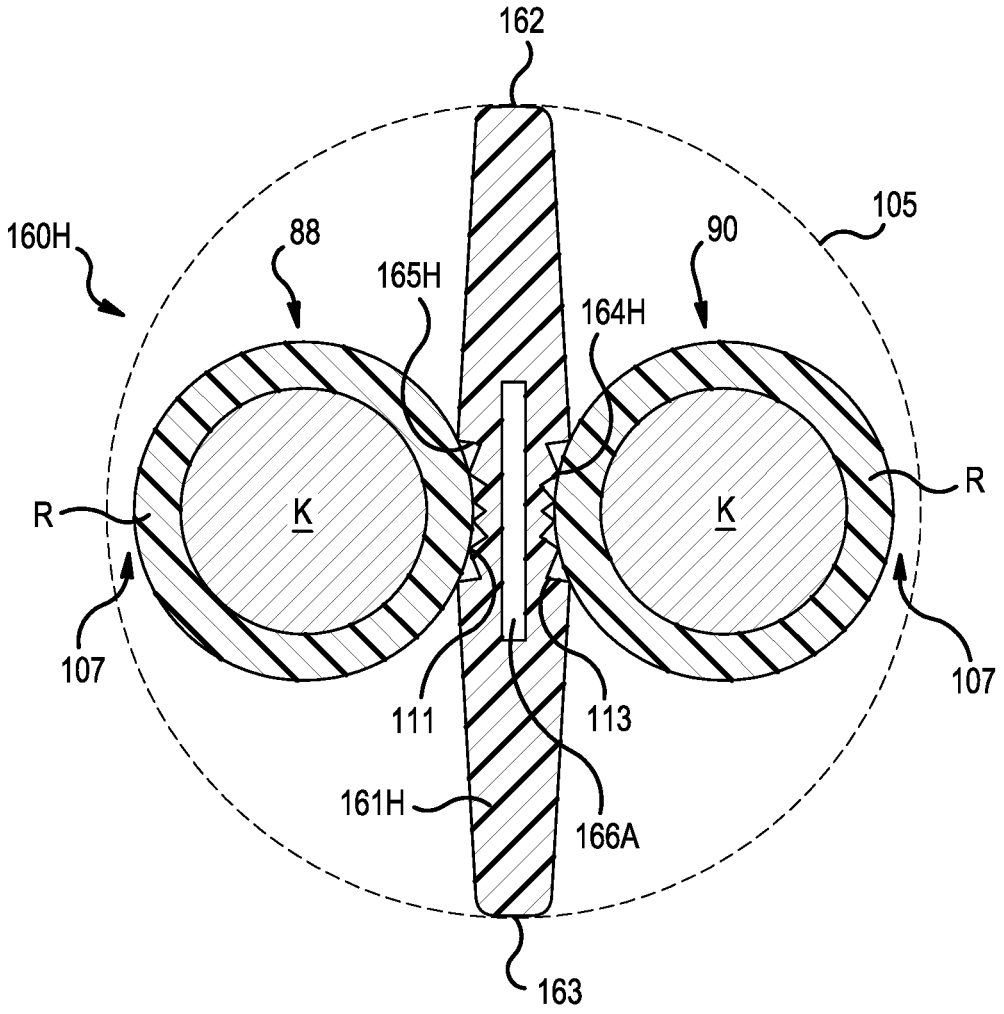
FIG. 23 is a close-up cross sectional view of a twisted pair, having a dielectric tape with an alternative configuration, in accordance with a sixteenth embodiment of the present invention.

FIG. 23 is a close-up cross sectional view of a twisted pair 160H, having a first dielectric tape 161H with an alternative configuration, in accordance with a sixteenth embodiment of the present invention. The sixteenth embodiment is the same as the fifteenth embodiment, except that the hollow core of the first dielectric tape 161H possesses air 166A instead of the foamed insulation material 166. The air 166A has a dielectric constant per unit volume of about 1.0, which is a lower dielectric constant as compared to the other materials used to form the first dielectric tape 161H. The air 166A improves the overall dielectric constant of the first dielectric tape 161H, e.g., reduces the overall dielectric constant of the first dielectric tape 161H.

Figure 24:
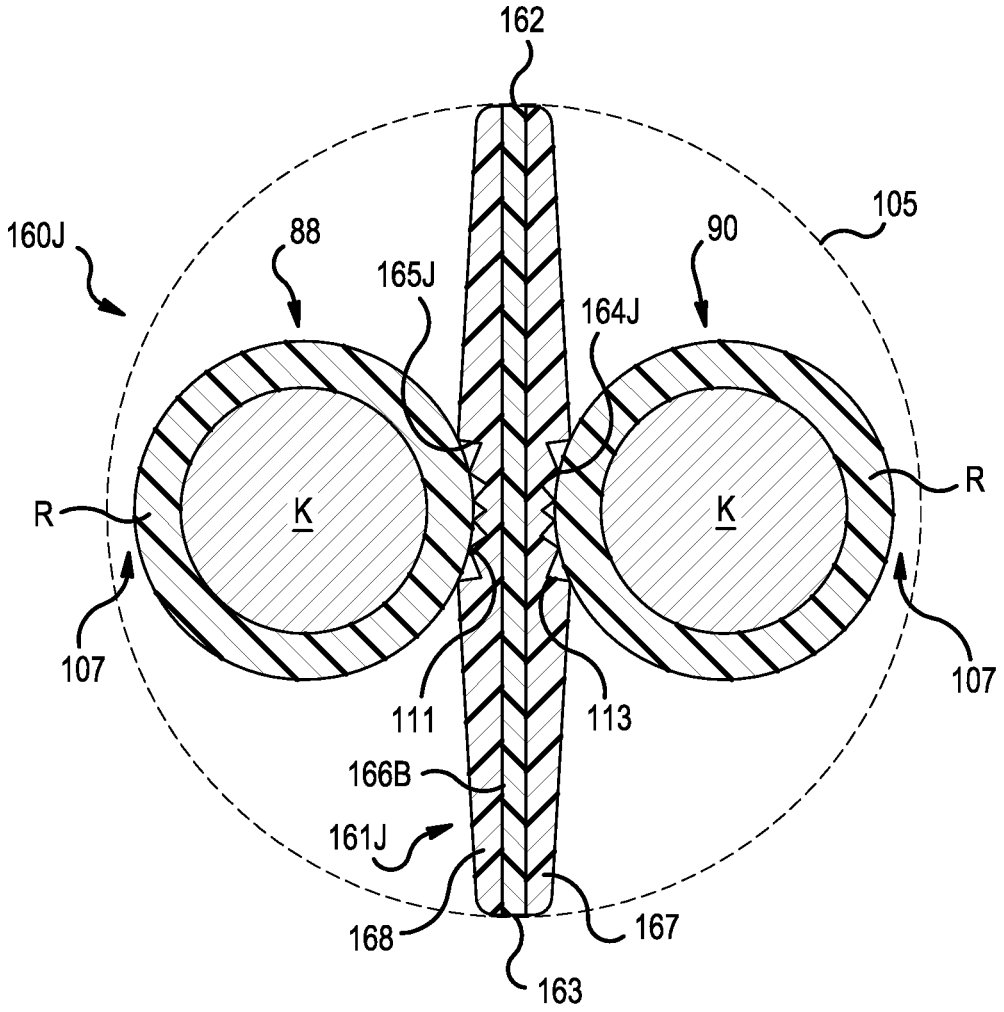
FIG. 24 is a close-up cross sectional view of a twisted pair, having a dielectric tape with an alternative configuration, in accordance with a seventeenth embodiment of the present invention.

FIG. 24 is a close-up cross sectional view of a twisted pair 160J, having a first dielectric tape 161J with an alternative configuration, in accordance with a seventeenth embodiment of the present invention. The seventeenth embodiment is the same as the fourteenth embodiment, except that the first dielectric tape 161J is formed of at least two different materials. A first side 168 of the first dielectric tape 161J, facing to the first insulated conductor 88, and a second side 167 of the first dielectric tape 161J, facing to the second insulated conductor 90, are formed of a first dielectric material. A mid-portion 166B of the first dielectric tape 161J is formed of a second dielectric material. A first dielectric constant of the first material is different from a second dielectric constant of the second material. In a preferred embodiment, the second dielectric constant is lower than the first dielectric constant. The second material improves the overall dielectric constant of the first dielectric tape 161J, e.g., reduces the overall dielectric constant of the first dielectric tape 161J.

Figure 25:
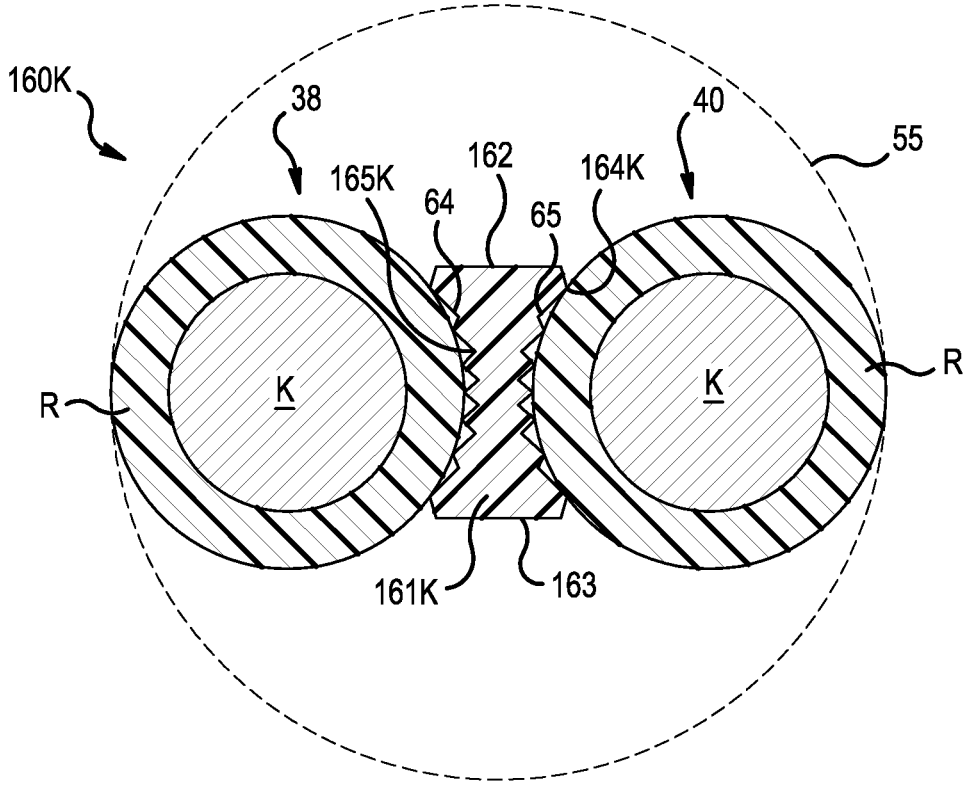
FIG. 25 is a close-up cross sectional view of a twisted pair, having a dielectric tape with an alternative configuration, in accordance with an eighteenth embodiment of the present invention.

FIG. 25 is a close-up cross sectional view of a twisted pair 160K, having a first dielectric tape 161K with an alternative configuration, in accordance with an eighteenth embodiment of the present invention. The eighteenth embodiment includes a first insulated conductor 38, a first dielectric tape 161K, and a second insulated conductor 40. The first insulated conductor 38 is twisted with the second insulated conductor 40 with the first dielectric tape 161K residing between the first insulated conductor 38 and the second insulated conductor 40 to form the twisted pair 160K. The first dielectric tape 161K has a width which extends approximately perpendicular to an extension length of the twisted pair 160K from a first edge 162 of the first dielectric tape 161K to an opposing second edge 163 of the first dielectric tape 161K. The width, in the embodiment of FIG. 25, is less than or equal to the diameter of the first insulated conductor 38 plus the diameter of the second insulated conductor 40 plus a thickness of the first dielectric tape 161K, located between the first and second insulated conductors 38 and 40. More preferably, the width is less than or equal to the diameter of the first insulated conductor 38.

The embodiment of FIG. 25 is similar in most regards to the embodiment of FIG. 6, but illustrates that the first dielectric tape 161K may include a plurality of ridges 164K and valleys 165K in at least the first recess 64 which seats the first insulated conductor 38. In a preferred embodiment, the first dielectric tape 161K includes a plurality of ridges 164K and valleys 165K in both the first recess 64, which seats the first insulated conductor 38, and in the second recess 65, which seats the second insulated conductor 40.

The insulation layers R of the first and second insulated conductors 38 and 40 engage the ridges 164K, so that the valleys 165K introduce air immediately adjacent to the insulation layers R of the first and second insulated conductors 38 and 40. Air has a dielectric constant of approximately 1.0, and the introduction of air close to the insulation layers R improves the overall dielectric constant of the first dielectric tape 161K, e.g., reduces the overall dielectric constant of the first dielectric tape 161K.

Figure 26:
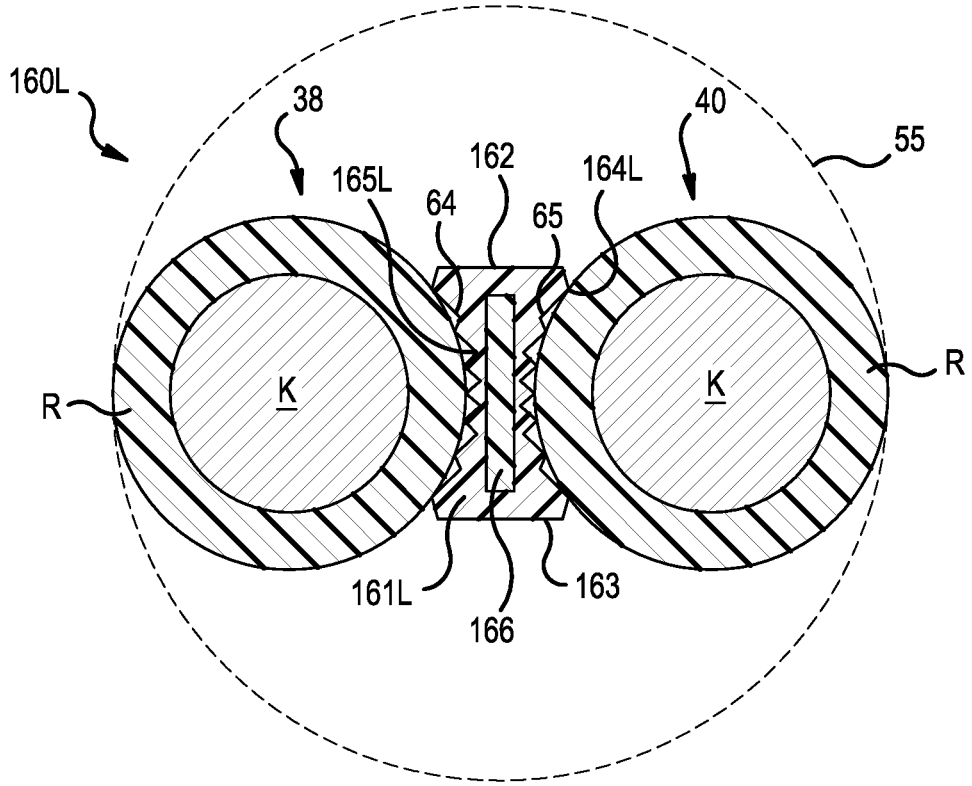
FIG. 26 is a close-up cross sectional view of a twisted pair, having a dielectric tape with an alternative configuration, in accordance with a nineteenth embodiment of the present invention.

FIG. 26 is a close-up cross sectional view of a twisted pair 160L, having a first dielectric tape 161L with an alternative configuration, in accordance with a nineteenth embodiment of the present invention. The nineteenth embodiment is the same as the eighteenth embodiment, except that the first dielectric tape 161L includes a hollow core possessing a foamed insulation material 166. The foamed insulation material 166 is formed of a material with a lower dielectric constant per unit volume, as compared to the other materials used to form the first dielectric tape 161L, which improves the overall dielectric constant of the first dielectric tape 161L, e.g., reduces the overall dielectric constant of the first dielectric tape 161L.

Figure 27:
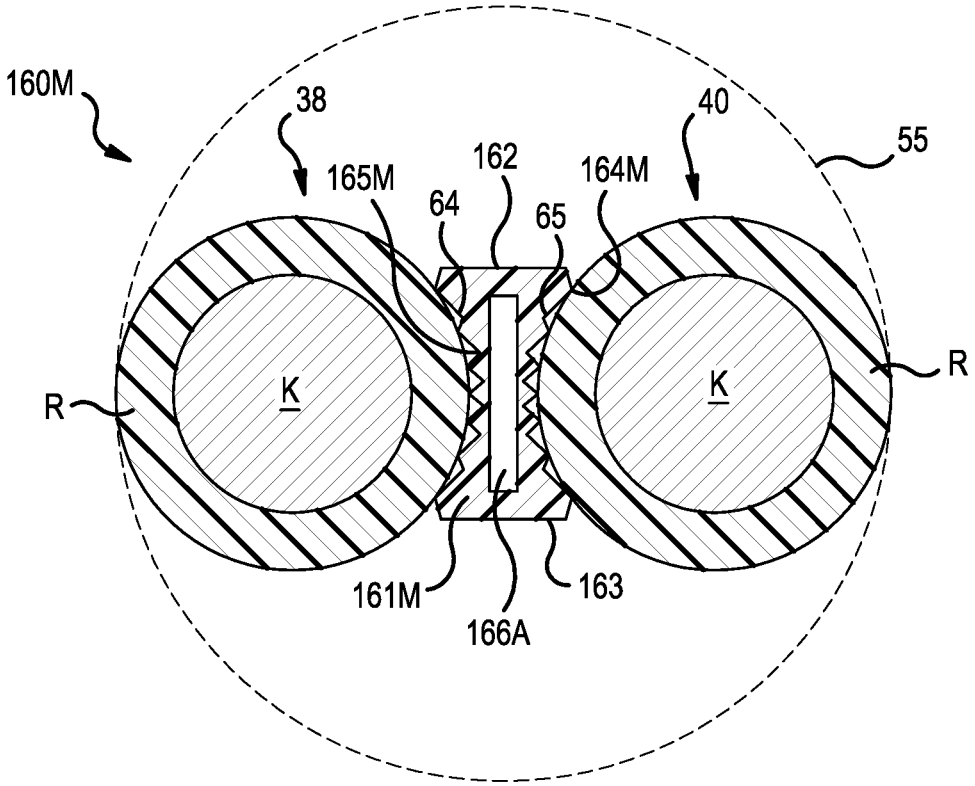
FIG. 27 is a close-up cross sectional view of a twisted pair, having a dielectric tape with an alternative configuration, in accordance with a twentieth embodiment of the present invention.

FIG. 27 is a close-up cross sectional view of a twisted pair 160M, having a first dielectric tape 161M with an alternative configuration, in accordance with a seventeenth embodiment of the present invention. The seventeenth embodiment is the same as the sixteenth embodiment, except that the hollow core of the first dielectric tape 161M possesses air 166A instead of the foamed insulation material 166. The air 166A has a dielectric constant per unit volume of about 1.0, which is a lower dielectric constant as compared to the other materials used to form the first dielectric tape 161M. The air 166A improves the overall dielectric constant of the first dielectric tape 161M, e.g., reduces the overall dielectric constant of the first dielectric tape 161M.

Figure 28:
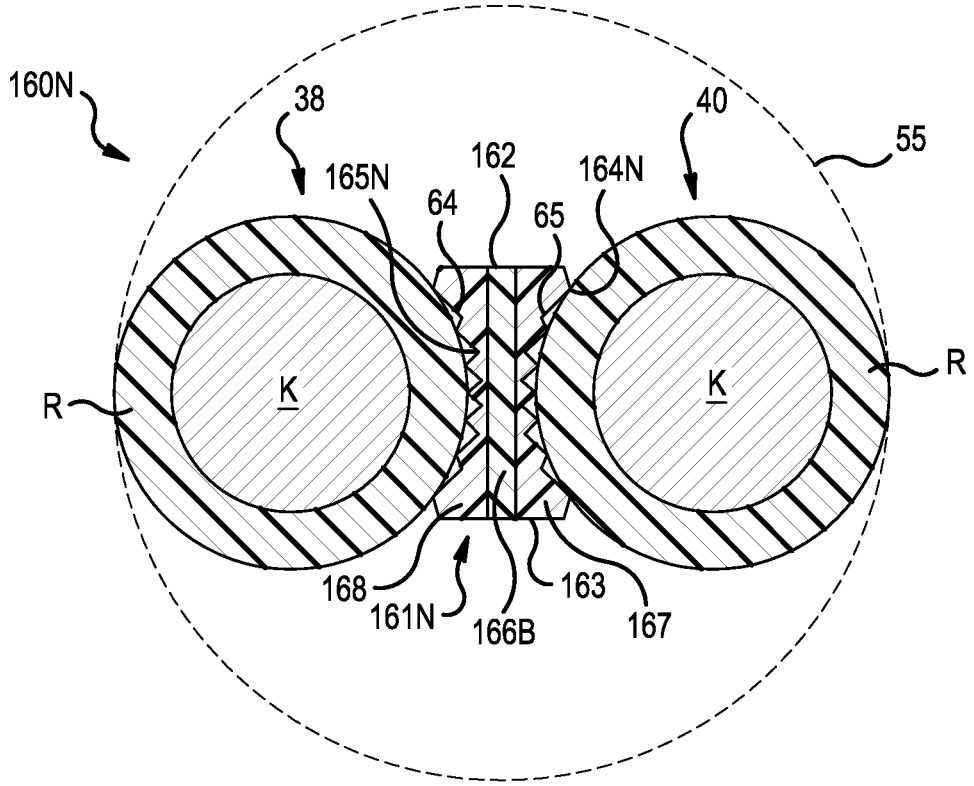
FIG. 28 is a close-up cross sectional view of a twisted pair, having a dielectric tape with an alternative configuration, in accordance with a twenty-first embodiment of the present invention.

FIG. 28 is a close-up cross sectional view of a twisted pair 160N, having a first dielectric tape 161N with an alternative configuration, in accordance with an eighteenth embodiment of the present invention. The eighteenth embodiment is the same as the fifteenth embodiment, except that the first dielectric tape 161N is formed of at least two different materials. A first side 168 of the first dielectric tape 161N, facing to the first insulated conductor 38, and a second side 167 of the first dielectric tape 161N, facing to the second insulated conductor 40, are formed of a first dielectric material. A mid-portion 166B of the first dielectric tape 161N is formed of a second dielectric material. A first dielectric constant of the first material is different from a second dielectric constant of the second material. In a preferred embodiment, the second dielectric constant is lower than the first dielectric constant. The second material improves the overall dielectric constant of the first dielectric tape 161N, e.g., reduces the overall dielectric constant of the first dielectric tape 161N.

In FIGS. 21-28, the plurality of ridges 164 are shaped in the form of angled peaks, and the plurality of valleys 165 are shaped in the form of angled valleys. The actual shapes of the ridges and/or valleys are not critical. Rather, an important aspect is the introduction of air into the first and second recesses 111, 113 or 64, 65, which contact the first and second insulated conductors 88, 90 or 38, 40. Therefore, the plurality of ridges 164 and the valleys 165 may have alternative shapes, such as the shapes illustrated in FIGS. 17-18.

In cables of the background art, different twist lengths were applied to each of the four twisted pairs. The different twist lengths had the benefit of reducing crosstalk between adjacent pairs within the cable. However, employing different twist lengths also created drawbacks, such as delay skew (e.g., it takes more time for a signal to travel to the far end of the cable on a relatively tighter twisted pair, as compared to a relatively longer twisted pair in the same cable). Differing twist lengths can also cause relative differences between the twisted pairs in such performance characteristics as attenuation and impedance.

In the background art, the insulation layers R were varied in thickness and/or material composition to compensate for the differences. For example, the insulation layers R of the insulated conductors 91 and 93 in the tighter twisted pair 84 (in FIG. 9) could be formed of a material with a different dielectric constant than the insulation layers R of the insulated conductors 94 and 96 in the longer twisted pair 85 (in FIG. 9). Also, air could be introduced into the insulation layers R to foam the insulation layers R. The foaming could be set at different levels for one or more of the twisted pairs, depending upon their twist length.

Such measures of the background art helped to offset the different performance characteristics induced by the different twist lengths of the twisted pairs. However, there was an added cost in that the insulated conductors used in different twisted pairs of the same cable had to be manufactured differently. This created a need for inventorying different types of insulated conductors and added more complexity in the manufacturing process.

In accordance with one embodiment of the present invention, the insulated conductors 38, 40, 41, 43, 44, 46, 47 and 49 of each of the twisted pairs 33, 34, 35 and 36 in the cable 31 may be made structurally identical (noting that certain non-structural features, like colors, stripe patterns or printed indicia may be employed to merely identify the insulated conductors from each other). In this embodiment of the present invention, the dielectric tape structure can be used to mitigate the performance differences, which arise when different twist lengths are employed in the twisted pairs. Moreover, the insulated conductors 38, 40, 41, 43, 44, 46, 47 and 49 may be made structurally identical and also be identical in appearance. In this embodiment, the color of, or indicia on, the first through fourth dielectric tapes 39, 42, 45 and 48 could be used to distinguish between the first through fourth twisted pairs 33, 34, 35 and 36 of the cable 31, when the cable 31 is terminated and a connector is attached thereto.

For example, the dielectric tape of one twisted pair of a given cable may be different in shape, size or material content as compared to the dielectric tape of another twisted pair in the same cable. In FIG. 4, the first dielectric tape 39 of the first twisted pair 33 has a first thickness, which sets a spacing distance between the first insulated conductor 38 and the second insulated conductor 40. In the third twisted pair 35, the third dielectric tape 45 has a second thickness, which sets a spacing distance between the fifth insulated conductor 44 and the sixth insulated conductor 46. The second thickness is different from the first thickness, which also means that the shape of the first dielectric tape 39 is different than the shape of the third dielectric tape 45.

In one embodiment, the difference between the second thickness and the first thickness is at least 1 mil. For example, the first dielectric tape 39 could have a thickness of about 10 mils, whereas the third dielectric tape 45 could have a thickness of about 8 mils. Such a change in thickness and shape will affect the respective performance characteristics of the first twisted pair 33 and the third twisted pair 35, such as their respective attenuation, impedance, delay skew, etc.

Also in FIG. 4, the first dielectric tape 39 of the first twisted pair 33 has a first width, which extends approximately perpendicular to an extension length of said cable 31 from its first edge 51 to its second edge 53 (See FIG. 5). In the fourth twisted pair 36, the fourth dielectric tape 48 has a second width, which extends approximately perpendicular to the extension length of said cable 31 from its corresponding first edge 51 to its corresponding second edge 53. The second width is different from the first width. For example, the second width may be several mils shorter than the first width, such as about 2 to 12 mils shorter, e.g., about 5 mils shorter. Again, the respective differences in width will serve to create differences in performance characteristics, which can be adjusted and used to offset for the performance differences created by the different twist lengths.

Also in FIG. 4, the first dielectric tape 39 of the first twisted pair 33 is formed of a first material having a first dielectric constant. In the second twisted pair 34, the second dielectric tape 42 is formed of a second material having a second dielectric constant (as illustrated by the different thicknesses in the cross hatching). The second dielectric constant is different from the first dielectric constant. For example, the second dielectric constant could differ from the first dielectric constant by about 0.1 to about 0.8, e.g., the first dielectric constant might be 1.2, whereas the second dielectric constant is 1.4, thus illustrating a difference of 0.2 in dielectric constant between the two materials. Again, the respective differences in material will serve to create differences in performance characteristics, which can be adjusted and used to offset for the performance differences created by the different twist lengths. Of course, the differences between the dielectric tapes can also be employed as a supplemental measure in conjunction with differences in insulation layers on the insulated conductors to provide an additional ability to compensate for performance differences between the twisted pairs.

The cables 31, 66, 81 and 140 of the present invention may be manufactured using standard twisting equipment, such as a double twist twinning machine, known in the art of twisted pair cable making. An additional spool would be added to feed the dielectric tape into the twisting machine between the insulated conductors of the twisted pair.

Although, the cables illustrated in the drawing figures have included four twisted pairs, it should be appreciated that the present invention is not limited to cables having only four twisted pairs. Cables having other numbers of twisted pairs, such as one twisted pair, two twisted pairs or even twenty-five twisted pairs, could benefit from the structures disclosed in the present invention. Further, although the drawing figures have illustrated that each of the twisted pairs within the cable have a dielectric tape, it would be possible for less than all of the twisted pairs to have the dielectric tape. For example, the first through third twisted pairs could include a dielectric tape, while the fourth twisted pair could be formed without a dielectric tape. Further, although the drawing figures have illustrated an unshielded cable, it is within the scope of the appended claims that the cable could include a shielding layer and/or a core wrap between the core of twisted pairs and the inner wall of the outermost jacket. Further, although some drawing figures have illustrated a jacket having a smooth inner wall, it is within the scope of the present invention that in all embodiments the inner wall of the jacket could include fins or projections (as illustrated in FIG. 8B) for creating air pockets around the perimeter of the core of twisted pairs. Further, all embodiments of the present invention may include a separator (e.g., tape, isolator, flute, crossweb).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

We claim:

1. A cable comprising:

a first insulated conductor, a first dielectric member, and a second insulated conductor, wherein said first insulated conductor is twisted with said second insulated conductor with said first dielectric member residing between said first insulated conductor and said second insulated conductor to form a first twisted pair; and a jacket formed around said first twisted pair, wherein said first dielectric member has a cross sectional shape in a direction perpendicular to an extension length of said first twisted pair, which presents a first recessed portion on a first side for seating said first insulated conductor and a second recessed portion on a second side for seating said second insulated conductor, and wherein said first dielectric member includes surface features in said first recessed portion to create pockets of air adjacent to a seated portion of said first insulated conductor.

2. The cable according to claim 1, wherein said surface features include a plurality of ridges and valleys in said first recessed portion.

3. The cable according to claim 2, wherein said plurality of ridges are shaped in the form of at least one of angled peaks, rectangular protrusions or curved protrusions, and wherein said plurality of valleys are shaped in the form of at least one of angled valleys, rectangular recesses, or curved recesses.

4. The cable according to claim 1, further comprising:

a third insulated conductor, a second dielectric member, and a fourth insulated conductor, wherein said third insulated conductor is twisted with said fourth insulated conductor with said second dielectric member residing between said third insulated conductor and said fourth insulated conductor to form a second twisted pair, and wherein said jacket is also formed around said second twisted pair.

5. The cable according to claim 4, wherein a first twist length of said first twisted pair is between approximately 0.22 inches and approximately 0.38 inches, and wherein a second twist length of said second twisted pair is different from said first twist length and is between approximately 0.22 inches and approximately 0.38 inches.

6. The cable according to claim 4, wherein said first twisted pair is stranded with said second twisted pair to form a stranded core.

7. A cable comprising:

a first insulated conductor, a first dielectric member, and a second insulated conductor, wherein said first insulated conductor is twisted with said second insulated conductor with said first dielectric member residing between said first insulated conductor and said second insulated conductor to form a first twisted pair; and a jacket formed around said first twisted pair, wherein said first dielectric member has a cross sectional shape in a direction perpendicular to an extension length of said first twisted pair, which presents a first recessed portion on a first side for seating said first insulated conductor and a second recessed portion on a second side for seating said second insulated conductor, wherein said first dielectric member includes surface features in said first recessed portion to create pockets of air adjacent to a seated portion of said first insulated conductor, and wherein said first dielectric member has a hollow core.

8. The cable according to claim 7, wherein said hollow core possesses a gas or material with a lower dielectric constant than a material used to form said first dielectric member.

9. The cable according to claim 8, wherein said first dielectric member is formed as a single unitary structure which does not include multiple pieces attached together or layered.

10. The cable according to claim 9, wherein said hollow core is partitioned into closed-cell pockets along a length of said first dielectric member.

11. The cable according to claim 10, wherein said closed-cell pockets are filled with air.

12. The cable according to claim 7, wherein said first dielectric member is formed as a single unitary structure which does not include multiple pieces attached together or layered.

13. The cable according to claim 7, wherein said first dielectric member has a first width which extends approximately perpendicular to the extension length of said first twisted pair from a first edge of said first dielectric member to a second edge of said first dielectric member, and wherein said first width is equal to or less than a diameter of said first insulated conductor plus a diameter of said second insulated conductor plus a thickness of said first dielectric member located between said first and second insulated conductors.

14. The cable according to claim 13, wherein said first width is less than a diameter of said first insulated conductor.

15. A cable comprising:

a first insulated conductor, a first dielectric member, and a second insulated conductor, wherein said first insulated conductor is twisted with said second insulated conductor with said first dielectric member residing between said first insulated conductor and said second insulated conductor to form a first twisted pair; and a jacket formed around said first twisted pair, wherein said first dielectric member has a cross sectional shape in a direction perpendicular to an extension length of said first twisted pair, which presents a first recessed portion on a first side for seating said first insulated conductor and a second recessed portion on a second side for seating said second insulated conductor, wherein said first dielectric member includes surface features in said first recessed portion to create pockets of air adjacent to a seated portion of said first insulated conductor, and wherein said first dielectric member has a first width which extends approximately perpendicular to the extension length of said first twisted pair from a first edge of said first dielectric member to a second edge of said first dielectric member, and wherein said first width is less than a diameter of said first insulated conductor plus a diameter of said second insulated conductor plus a thickness of said first dielectric member located between said first and second insulated conductors.

16. The cable according to claim 15, wherein said surface features include a plurality of ridges and valleys in said first recessed portion.

17. The cable according to claim 16, wherein said plurality of ridges are shaped in the form of at least one of angled peaks, rectangular protrusions or curved protrusions, and wherein said plurality of valleys are shaped in the form of at least one of angled valleys, rectangular recesses, or curved recesses.

18. The cable according to claim 15, further comprising: a third insulated conductor, a second dielectric member, and a fourth insulated conductor, wherein said third insulated conductor is twisted with said fourth insulated conductor with said second dielectric member residing between said third insulated conductor and said fourth insulated conductor to form a second twisted pair, and wherein said jacket is also formed around said second twisted pair.

19. The cable according to claim 18, wherein a first twist length of said first twisted pair is between approximately 0.22 inches and approximately 0.38 inches, and wherein a second twist length of said second twisted pair is different from said first twist length and is between approximately 0.22 inches and approximately 0.38 inches.

20. The cable according to claim 18, wherein said first twisted pair is stranded with said second twisted pair to form a stranded core.

* * * * *